US011137202B2

(12) United States Patent
Hanson et al.

(10) Patent No.: US 11,137,202 B2
(45) Date of Patent: Oct. 5, 2021

(54) MODULAR LED ILLUMINATION DEVICE

(71) Applicant: Electrolux Home Products, Inc., Charlotte, NC (US)

(72) Inventors: Josh Hanson, Huntersville, NC (US); Matthew Ortner, Huntersville, NC (US); Robert Rankin Mckechnie, IV, Concord, NC (US); James T. Mchan, Anderson, SC (US); Cleo Rudolph Fulgham, Jr., Easley, SC (US); John Thomas Campbell, III, Pendleton, SC (US); Raony Barrios, Anderson, SC (US); William Thomas Anniss, III, Anderson, SC (US); Matthew Bobinski, Anderson, SC (US); Cory Dale Simpson, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 8 days.

(21) Appl. No.: 16/582,524

(22) Filed: Sep. 25, 2019

(65) Prior Publication Data

US 2021/0088271 A1 Mar. 25, 2021

(51) Int. Cl.
*F25D 27/00* (2006.01)
*F21S 2/00* (2016.01)
(Continued)

(52) U.S. Cl.
CPC ..... *F25D 27/00* (2013.01); *F21S 2/005* (2013.01); *F21V 3/02* (2013.01); *F21V 7/04* (2013.01);
(Continued)

(58) Field of Classification Search
CPC .. F25D 27/00; F21S 2/005; F21V 3/02; F21V 7/04; F21V 13/10; F21V 15/01; F21V 19/0015; F21V 23/06; F21V 33/0044
See application file for complete search history.

(56) References Cited

U.S. PATENT DOCUMENTS 8,186,844 B2 5/2012 Hall
8,235,539 B2 8/2012 Thomas et al.
(Continued)

FOREIGN PATENT DOCUMENTS

CN 108397968 8/2018
JP 2012154578 8/2012

OTHER PUBLICATIONS

International Search Report for PCT/US2020/050346, dated Feb. 8, 2021, 3 pages.

*Primary Examiner* — Mary Ellen Bowman
(74) *Attorney, Agent, or Firm* — Pearne & Gordon LLP

(57) ABSTRACT

A refrigeration appliance includes a compartment for storing food items in a refrigerated environment, the compartment being illuminated by at least one modular LED illumination device. The portion of the illumination device disposed within the compartment is generally flush with a mounting section and includes an LED lighting module arranged in a housing. The module has a board member, two or more LED light sources electrically connected to one another and to the board member, and two or more electrical edge connections for allowing electrically parallel connection between two or more modules being interchangeable with one another. A concave reflecting surface is positioned adjacent the module with a majority of light emitted from the LED light sources being incident thereon for reflection into the compartment. A liner defining the compartment has the mounting section
(Continued)

to which the housing is mounted, where the mounting section has an inward draft angle.

19 Claims, 18 Drawing Sheets

(51) Int. Cl.

| | |
|---|---|
| ***F21V 3/02*** | (2006.01) |
| ***F21V 7/04*** | (2006.01) |
| ***F21V 13/10*** | (2006.01) |
| ***F21V 15/01*** | (2006.01) |
| ***F21V 19/00*** | (2006.01) |
| ***F21V 23/06*** | (2006.01) |
| ***F21V 33/00*** | (2006.01) |
| ***F25D 11/02*** | (2006.01) |
| ***F21Y 115/10*** | (2016.01) |
| ***F21W 131/305*** | (2006.01) |

(52) U.S. Cl.
CPC ..... *F21V 13/10* (2013.01); *F21V 15/01* (2013.01); *F21V 19/0015* (2013.01); *F21V 23/06* (2013.01); *F21V 33/0044* (2013.01); *F25D 11/02* (2013.01); *F21W 2131/305* (2013.01); *F21Y 2115/10* (2016.08)

(56) References Cited

U.S. PATENT DOCUMENTS

| | | | | |
|---|---|---|---|---|
| 8,317,349 | B2 | 11/2012 | Hernandez | |
| 8,459,818 | B2 | 6/2013 | Becke et al. | |
| 8,888,306 | B2 | 11/2014 | Thomas et al. | |
| 8,956,005 | B2 | 2/2015 | Thomas et al. | |
| 8,985,795 | B2 | 3/2015 | Thomas et al. | |
| 9,127,874 | B2 * | 9/2015 | Ye | F21V 21/025 |
| 9,163,812 | B2 | 10/2015 | Thomas et al. | |
| 9,671,104 | B2 | 6/2017 | Becke et al. | |
| 9,702,618 | B2 | 7/2017 | Thomas et al. | |
| 9,763,526 | B2 | 9/2017 | Thomas et al. | |
| 2010/0164384 | A1 | 7/2010 | Ku et al. | |
| 2013/0027906 | A1 | 1/2013 | Ueda et al. | |
| 2013/0155705 | A1 | 6/2013 | Peck et al. | |
| 2016/0035924 | A1 * | 2/2016 | Oraw | H05K 1/189 136/244 |
| 2018/0017317 | A1 * | 1/2018 | Adachi | F21V 5/10 |
| 2019/0011120 | A1 | 1/2019 | Signorino | |

* cited by examiner

MODULAR LED ILLUMINATION DEVICE

FIELD OF THE INVENTION

This application relates generally to an illumination device for a kitchen appliance, and more particularly, to a modular LED illumination device for a refrigeration appliance.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Conventional refrigeration appliances include illumination devices for illuminating the otherwise dark interior cabinets of such appliances. The conventional illumination devices used often suffer from non-uniform light provision such as having hotspots, and user-viewed pinpoints. These illumination devices also are typically uniquely designed for each appliance and even for a specific position within a particular appliance.

Additionally, conventional refrigeration appliances, such as domestic refrigerators, typically include liners that must be drafted (i.e., angled) significantly in order to be removed from the plastic molding tool. The traditional use of draft/angle on the tooling means that any lighting module installed on the sidewalls of the refrigerator unfortunately will be outwardly angled to be facing outside or nearly outside the cabinet. In an attempt to direct more emitted light into the cabinet, rather than outwards toward an opening of the cabinet, some illumination devices include complex housings extending into the cabinet, protruding into otherwise usable space and getting in the way of insertion and removal of items.

BRIEF SUMMARY OF THE INVENTION

Aspects of the present disclosure may address one or more of the deficiencies described above while providing an illumination device that improves illumination of the interior cavity of an appliance, such as a refrigeration application, also referred to as a refrigerator.

In accordance with one aspect, there is provided a refrigeration appliance that includes a compartment for storing food items in a refrigerated environment, and an illumination device mounted at a mounting section of a wall of the compartment to illuminate the compartment. The illumination device includes a housing mounted at the mounting section, an LED lighting module arranged in the housing, the module having a board member and two or more LED light sources electrically connected to one another and to the board member. A concave reflecting surface is positioned adjacent the module to reflect light incident on the concave reflecting surface into the compartment. The LED light sources are aimed such that a majority of light emitted from the LED light sources is incident on the concave reflecting surface. The LED lighting module includes two or more electrical edge connections electrically connected in parallel to allow for an electrically parallel connection of two or more LED lighting modules to one another.

In accordance with another aspect, there is provided an illumination device for being mounted at a wall of a liner of a refrigeration appliance. The illumination device includes a housing having an engagement surface mountable at one of an inner or an outer surface of the wall of the liner, the housing having a curved surface, and the housing including a main body and a cover removably couplable to the main body, and a pair of LED lighting modules retained by the cover and having a board member and two or more electrical edge connections electrically connected in parallel to allow for electrically parallel connection of the LED lighting modules to one another. The LED lighting modules each further include two or more LED light sources electrically connected to one another and to the board member. A majority of light emitted from the two or more LED light sources is reflected off of the curved surface prior to being incident on an inner surface of the cover and lighting modules are interchangeable in their respective positions retained by the cover.

In accordance with still another aspect, there is provided a liner for defining a compartment of a refrigeration appliance. The liner includes a rear wall, a top wall and a bottom wall disposed opposite one another and extending outwardly from the rear wall to respective end portions, and oppositely disposed left and right side walls extending outwardly from the rear wall to a respective end portion, the left and right side walls being connected to the top and bottom walls to define a generally rectangular compartment having an open side. The open side defines an opening extending along an opening plane. A vertically-extending bisecting plane of the compartment is disposed orthogonal to the opening plane and extending between the opening plane and the rear wall. A respective end portion of at least one of the top wall, bottom wall, left side wall or right side wall has a mounting section for having an illumination device mounted thereto, the mounting section extending along an inward draft direction that is directed outwardly from the compartment and inwardly toward the bisecting plane.

The foregoing and other features of the invention are hereinafter described in greater detail with reference to the accompany drawings.

BRIEF DESCRIPTION OF THE DRAWINGS

The accompanying drawings, which are not necessarily to scale, show various aspects of the disclosure.

DESCRIPTION OF EXAMPLE EMBODIMENTS

Figure 1:
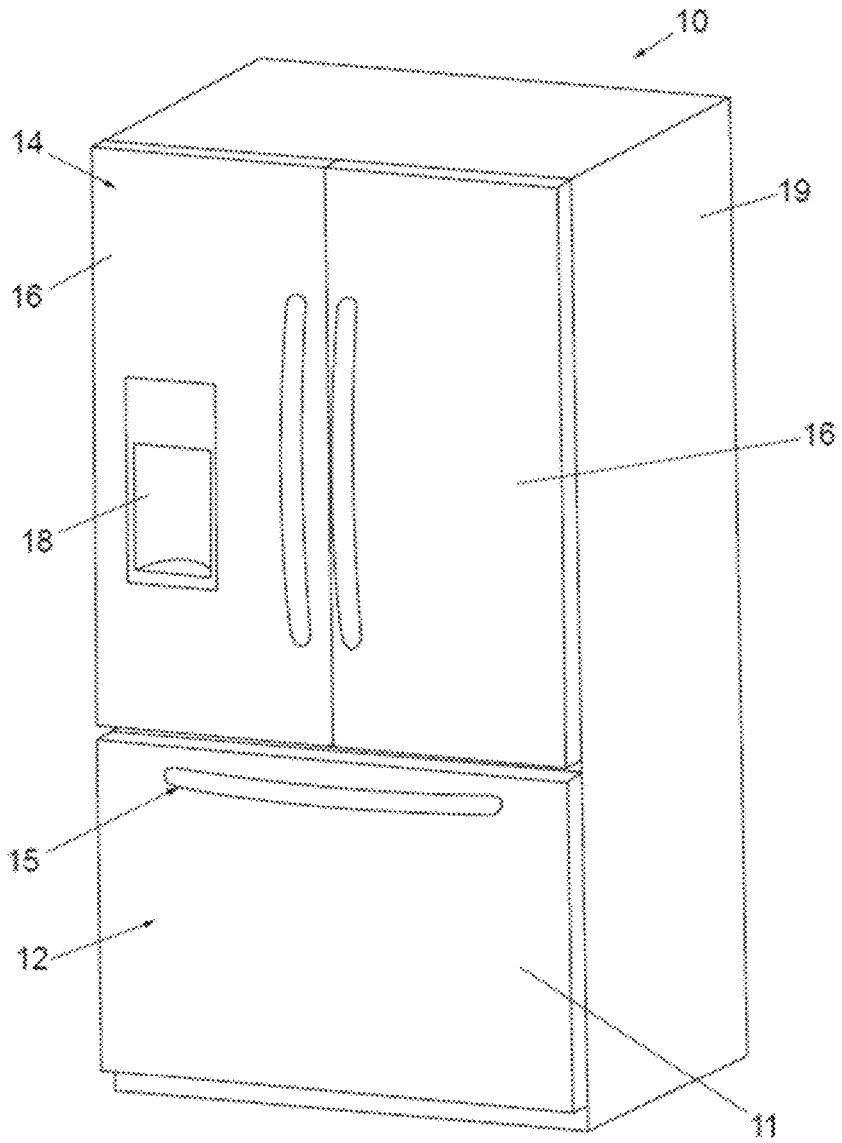
FIG. 1 is a front perspective view of a household French door bottom mount refrigerator showing doors of the fresh food compartment and drawer of a freezer compartment in a closed position.

Generally disclosed is a refrigeration appliance that includes a compartment for storing food items in a refrigerated environment, the compartment being illuminated by at least one modular LED illumination device. The portion of the illumination device disposed within the compartment is generally flush with the mounting section to provide a minimal footprint and includes an LED lighting module arranged in a housing. The module has a board member, two or more LED light sources electrically connected to one another and to the board member, and two or more electrical edge connections for allowing electrically parallel connection between two or more modules being interchangeable with one another. A concave reflecting surface is positioned adjacent the module with a majority of light emitted from the LED light sources being incident thereon for reflection into the compartment. A liner defining the compartment has a mounting section to which the housing is mounted, where the mounting section has an inward draft angle to allow for aiding in direction of a major quantity of light emitted from the illumination device into the compartment, rather than towards an opening of the compartment.

Embodiments of a refrigerator or a component thereof will now be described with reference to the accompanying drawings. Whenever possible, the same reference numerals are used throughout the drawings to refer to the same or like parts.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotably coupled to a cabinet 19 of the refrigerator 10 to restrict and grant access to the fresh food compartment 14. The door 16 can include a single door that spans the entire lateral distance across the entrance to the fresh food compartment 14, or can include a pair (i.e., two) of French-type doors 16 as shown in FIG. 1 that collectively span the entire lateral distance of the entrance to the fresh food compartment 14 to enclose the fresh food compartment 14. For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 23 (FIG. 2) of an ice maker 29 disposed within the fresh food compartment 14. Ice pieces from the ice bin 23 can exit the ice bin 23 through an aperture 31 and be delivered to the dispenser 18 via an ice chute 22 (FIG. 2), which extends at least partially through the door 16 between the dispenser 18 and the ice bin 54.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
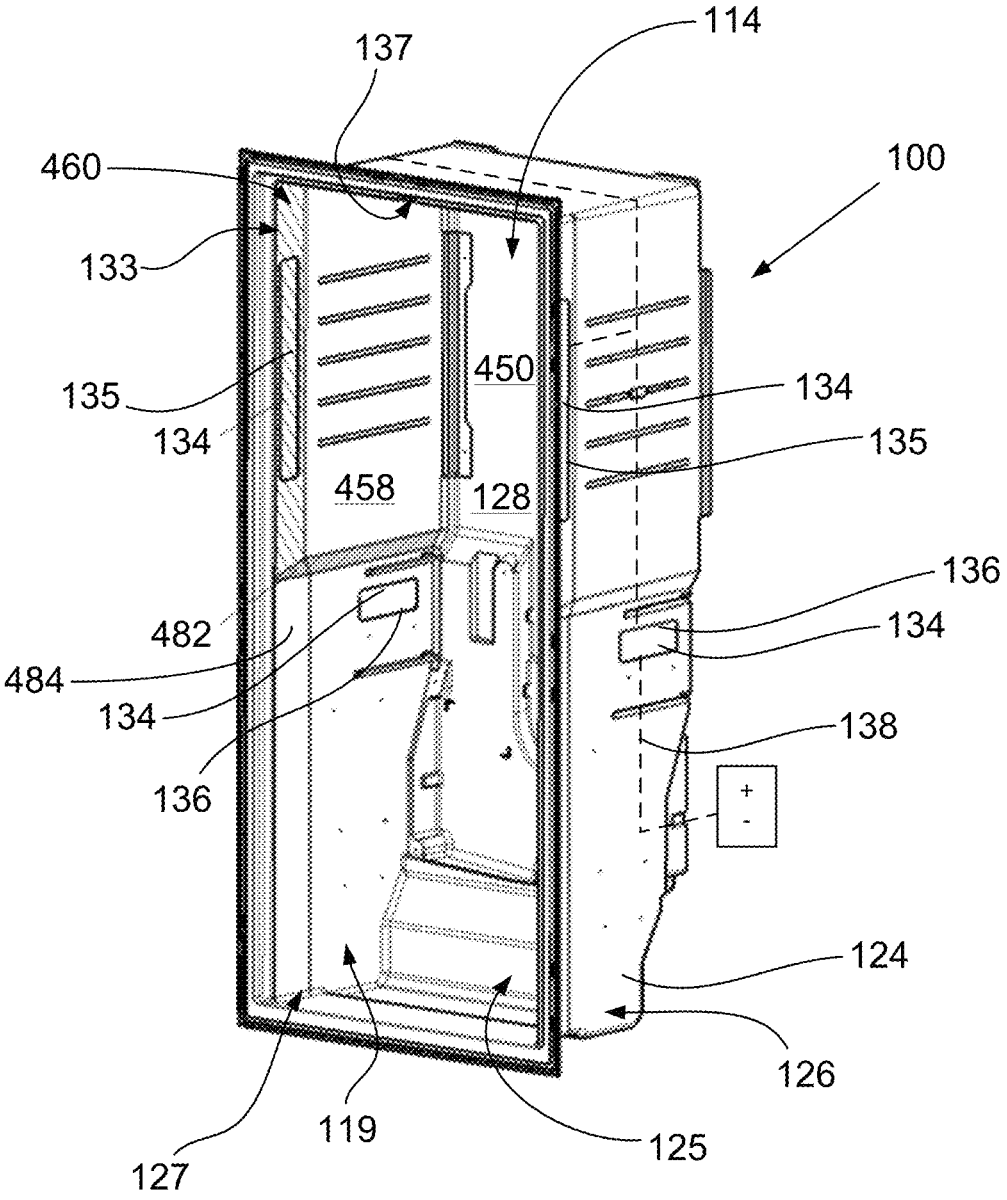
FIG. 3 is a front perspective view of portions of an example refrigerator according to the present disclosure, the figure showing a liner of a refrigerator according to the present disclosure and including a plurality of illumination devices also according to the present disclosure.

Turning now to FIG. 3, a portion of another refrigerator 100 is illustrated with aspects removed for visualization of still other aspects. The refrigerator 100 is substantially similar to the refrigerator 10 discussed above except it is a single compartment appliance without a separate freezer compartment, and as otherwise discussed below. Aspects of the refrigerator 100 that are similar to aspects of the refrigerator 10 are identified with the same reference numbers, but indexed by 100. It will be appreciated that aspects of the refrigerator 10 may be incorporated into the refrigerator 100 and vice versa.

The refrigerator 100 includes an interior liner 124 that at least partially defines a fresh food compartment 114. The liner 124 may be formed by any suitable process, such as preferably by vacuum form molding, or by thermoforming or rotomolding. The liner 124 has an inner side 125 disposed opposite an outer side 126 and is configured, such as being shaped, to be inserted into a casing (not shown) and coupled to the casing by any suitable method. It is understood that insulation subsequently will be inserted into an insulation space formed between the liner 124 and the casing to form a cabinet 119 of the refrigerator 100. The insulation typically is fluidly injected, such as foamed, into the insulation space, which is disposed about the outer side 126 of the liner 124.

As illustrated in FIG. 3, the compartment 114 may be illuminated by one or more, such as a plurality, of illumination devices 134 disposed at different locations of the compartment 114, electrically connected to one another and to a power source, and mounted to the liner 124 at respective mounting sections 133. The illumination devices 134 are shaped to be mounted at respective mounting sections 133 of the liner 124 (FIG. 3), such as at an orifice of the liner 124, which orifice may be provided by an integral hole or by knocking-out a knockout portion (not shown) of the liner 124. During manufacturing of the refrigerator 100, for example, knockouts may be removed and portions of the illumination devices 134 may be provided at the resulting orifices. The illumination devices 134 may be connected to the liner 124 at these locations or may be temporarily held in place, such as via tape, and electrical connection made between the respective portions of the illumination devices 134 (e.g., daisy chaining) prior to insertion of the liner 124 into the casing and a subsequent foaming operation.

The illumination devices 134 are light emitting diode-type (LED) devices each including one or more LED light sources for emitting light into the compartment 114. The illumination devices 134 are designed to be modular in that inner components, such as LED lighting modules (to be discussed below in detail) each including one or more LED light sources, may be arranged in any of the illumination devices 134 and interchanged between the illumination devices 134. This concept allows for using the same LED lighting modules in different numbers and/or arrangements and/or in differently sized housings of illumination devices across numerous appliance platforms.

For example, as depicted in FIG. 3, the plurality of illumination devices 134 are mounted at respective mounting sections 133 and include a pair (i.e., two) of long 3-by devices 135 and a pair (i.e., two) of wide 2-by devices 136. The 3-by devices 135 each include three LED lighting modules, while the 2-by devices 136 each include a pair (i.e., two) of LED lighting modules, with each of the illumination devices 135 and 136 including interchangeable LED lighting modules.

Figure 14:
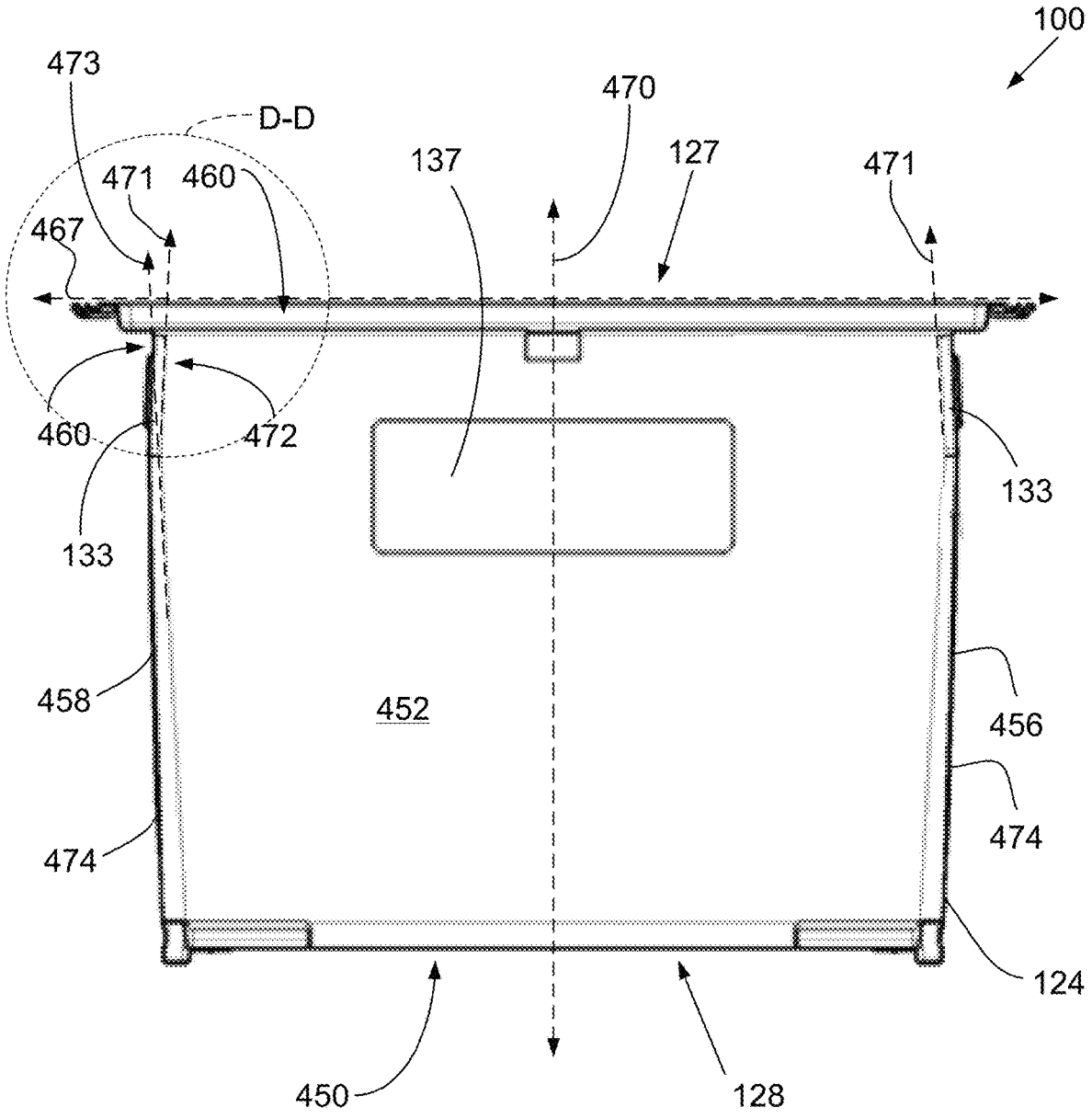
FIG. 14 is a view of the refrigerator taken along line B-B of FIG. 13.

A ceiling illumination device 137 also is provided, and is generally referenced at FIG. 3 (see also FIG. 14). For example, the ceiling illumination device 137 may have a shape with a width similar to the wide 2-by devices 136 and length similar to the long 3-by devices 135. This illumination device 137 is described in greater detail below, with reference to FIG. 12.

In various embodiments, other sized devices also may be included, or one or more of the device 135-137 may be omitted. In some embodiments, one or more of the 2-by or 3-by devices may be 1-by or 4+-by devices, and/or any number of additional or fewer devices may be used than as illustrated.

Via the aforementioned modularity, processes for the illumination devices 134 such as manufacturing, maintenance, repair, etc., may be reduced and made more efficient. The illumination devices 134 can be electrically connected to one another via electrically parallel connections to allow for power distribution to each of the interconnected illumination devices 134. Additionally, the respective housings of each of the illumination devices 134, mounted at the liner 124, have identical connections (data, electrical, etc.) and similar outer housing shapes to allow for ease of connection and placement during manufacturing, maintenance, repair, etc.

The illumination devices 134 are configured to reduce hotspots—areas of increased brightness as compared to adjacent less-illuminated areas—within the compartment 114. Light emitting from an illumination device 134 generally is evenly distributed throughout an area being lit by the illumination device 134, with other illumination devices placed relative thereto for evenly distributing light throughout other areas of the compartment, such as including some overlap of illuminated areas to avoid areas of non-illumination. The illumination devices 134 also are configured to reduce or altogether eliminate the viewing of pinpoint light by the user when opening and using the refrigerator 100 in a typical manner, inserting and removing items from the compartment 114 via an opening 127 of the compartment 114.

To provide power to the illumination devices 134, the refrigerator 100 includes a power line 138, which is connected to at least one illumination device 134 to allow for provision of power to each of the illumination devices 134 included in the refrigerator 100. The power line 138 may connect to a discrete power source of the refrigerator 100 or may use typical line-in power from plugging of the refrigerator into a wall outlet, for example. The power line and associated circuitry can be configured for low-voltage DC power, preferably, or can also be configured for AC power in other embodiments.

Figure 4:
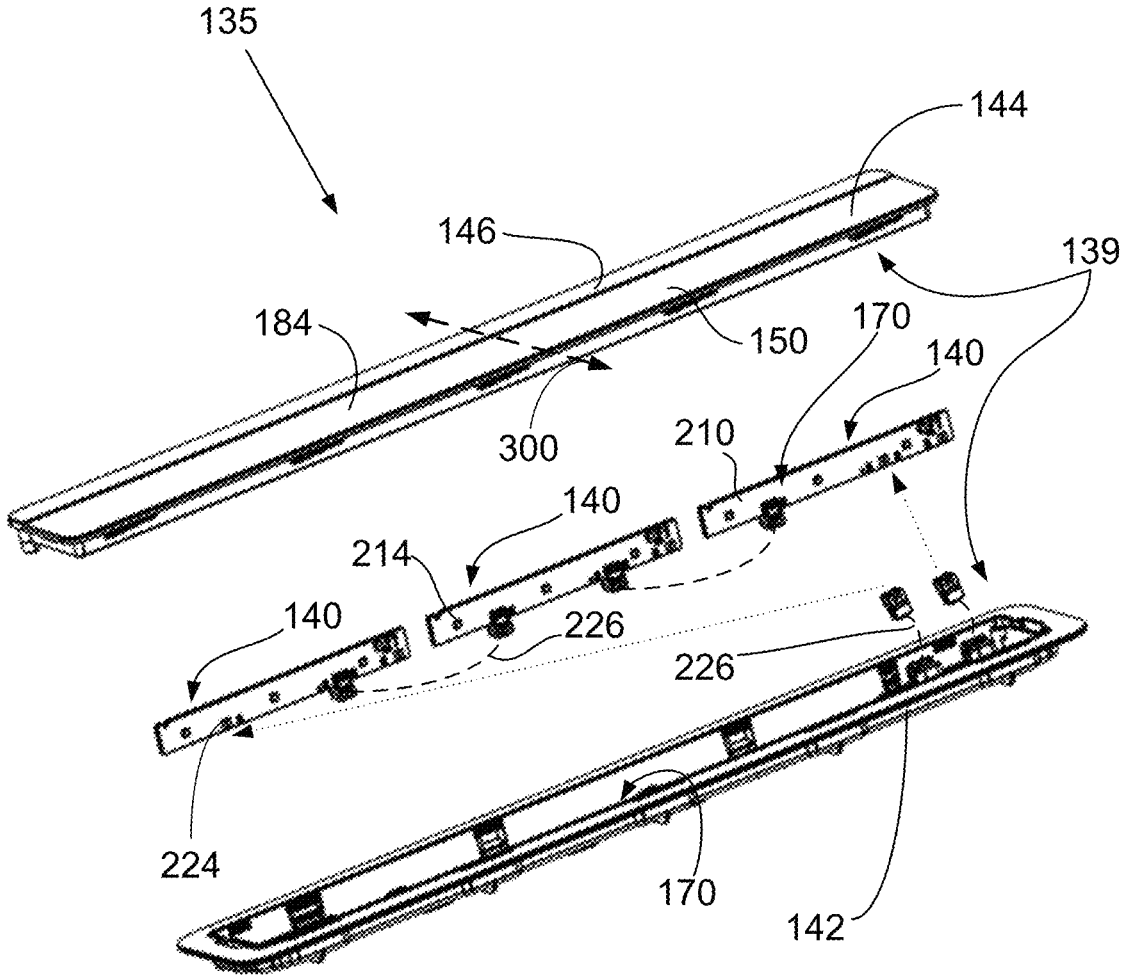
FIG. 4 is an exploded view of the components of an illumination device shown in FIG. 3.

Referring now to FIG. 4, a single illumination device 135 is depicted, and aspects of the illumination device to be described below may be applicable to other illumination devices having differing configurations, as also will be described.

The illumination device 135 illustrated includes at least a housing 139 and one or more LED lighting modules 140 arranged in the housing 139 and each including one or more LED light sources. The housing 139 is shaped to retain the one or more LED lighting modules 140 fully within the housing 139, although in other embodiments, a portion of one or more LED lighting modules 140, such as an electrical connection of a module 140, may be disposed external to the housing.

The housing 139 includes a main body 142 and a cover 144 coupled to one another, such as via a snap fit. The cover 144 is removable from the main body 142, such as for purposes of accessing an LED lighting module 140 attached thereto. The main body 142 and the cover 144 may be made of any suitable material, such as plastics. The cover 144 is comprised of a translucent material, for example having two or more surface finishes, their separation delineating two areas of cover 144—an outward area 146 being generally opaque and a lens area 150 being mare transparent. The areas 146 and 150 may be integrally formed at one element of the cover 144 or alternatively may be areas of intercoupled elements of the cover 144.

Figure 5:
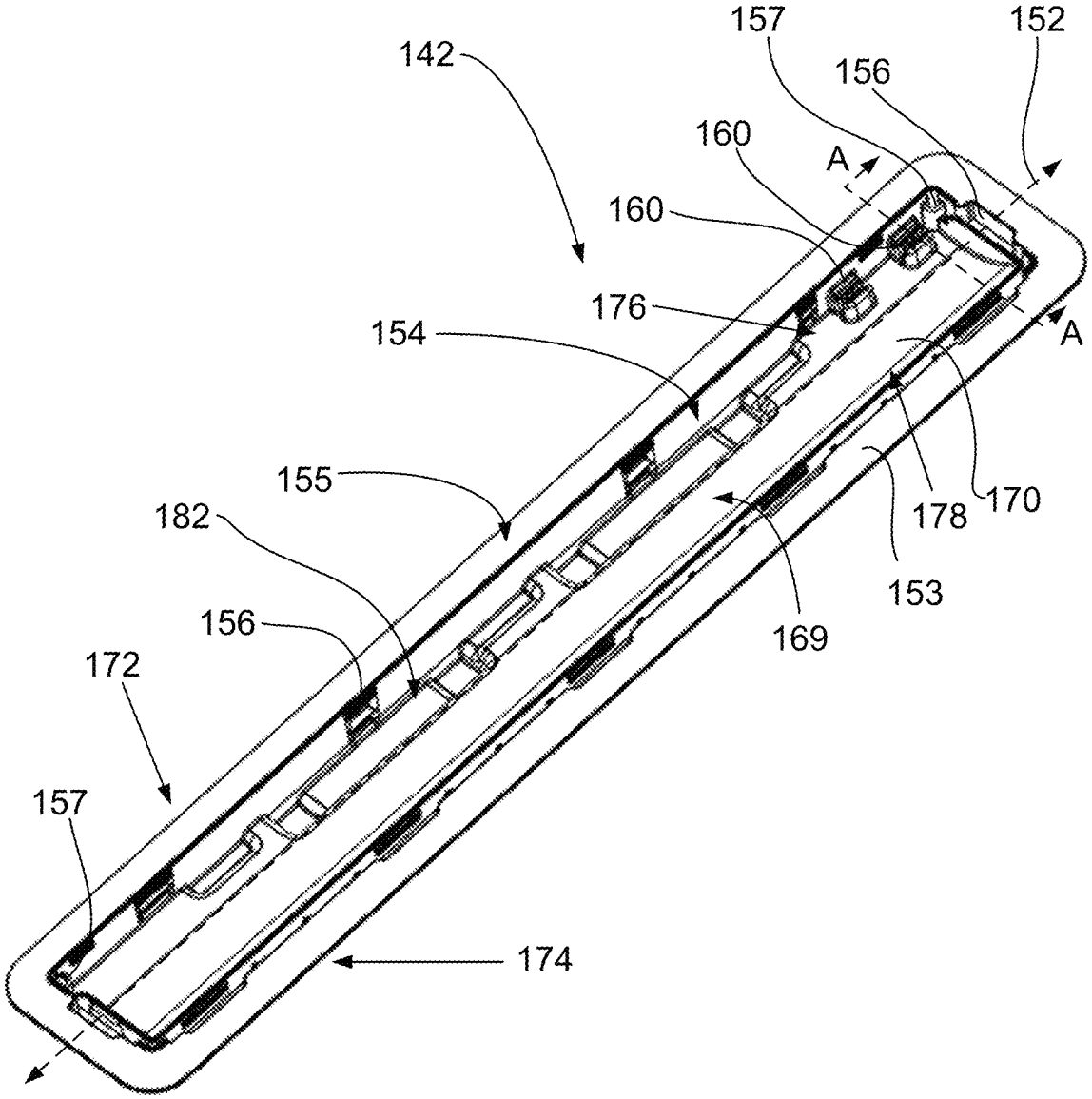
FIG. 5 is a top perspective view of a main body of the illumination device of FIG. 4 without a cover.
Figure 6:
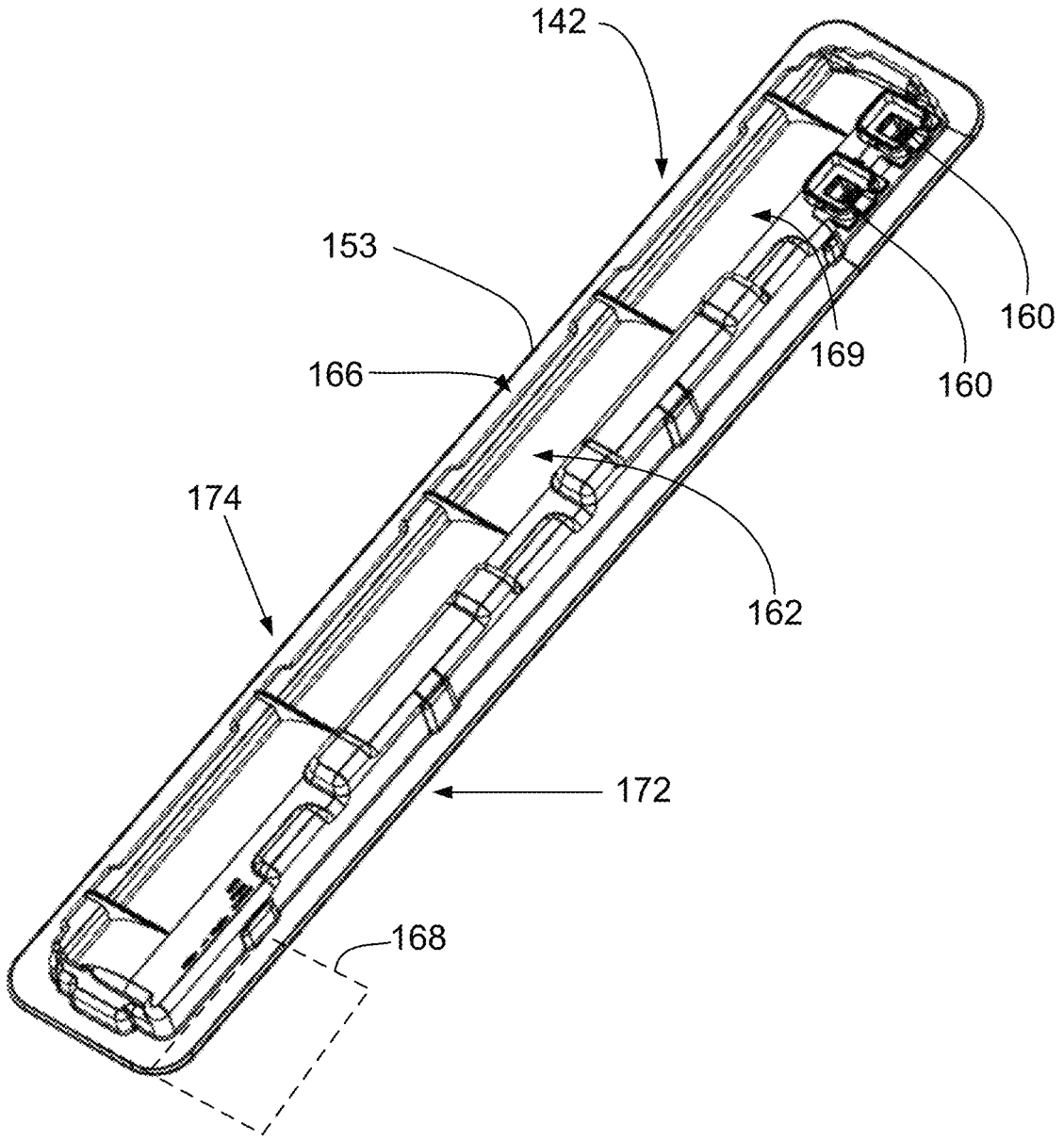
FIG. 6 is a bottom perspective view of the main body of the illumination device of FIG. 4.
Figure 7:
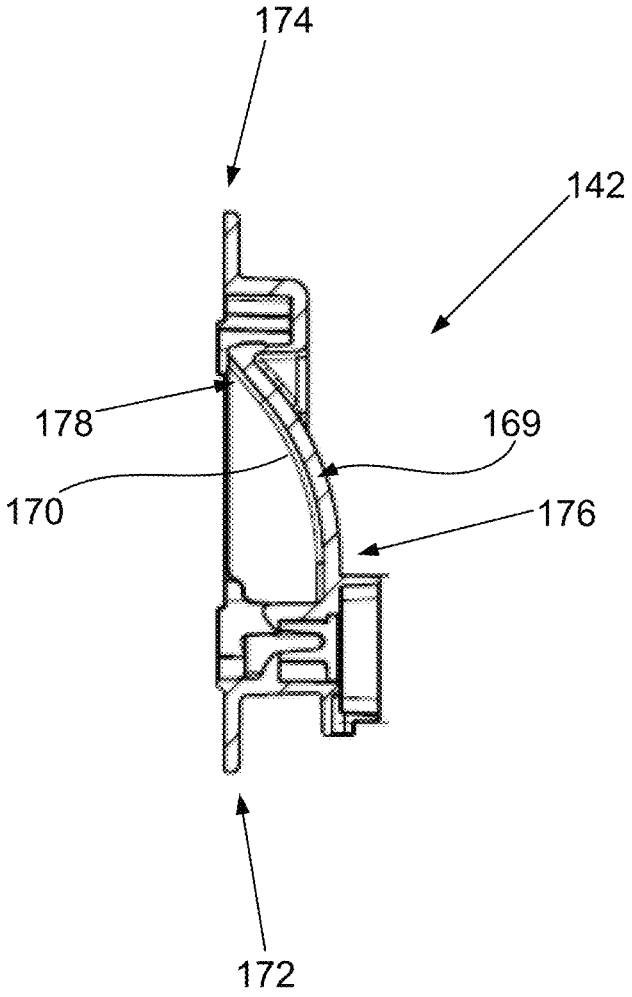
FIG. 7 is a cross-sectional view taken along the line A-A of FIG. 5.

Turning now to FIGS. 5 to 7, the main body 142 is shown separate from the cover 144 and separate from any included LED lighting modules 140. The main body 142 extends along a longitudinal axis 152 and defines a lip 153 surrounding and extending laterally outward from a compartment 154 extending into a top side 155 of the main body 142. The compartment 154 is shaped to receive one or more of the LED lighting modules 140 therein. Specifically, the depicted main body 142 has a length extending along the longitudinal axis 152 sufficient for receipt of three LED lighting modules 140. In other embodiments, one or more modules 140 may be included, such as where the length or lateral width (orthogonal to the length) of said main body is configured to include a different number of modules.

The main body 142 defines a plurality of snap features 156, such as ridges or grooves, for mating with corresponding snap features of the respective cover 144. In the depicted embodiment, the main body 142 includes a mix of key-type and slot-type snap features 156 for correspondingly mating with the other of the key-type and slot-type snap features of the cover 144. In other embodiments, any number of the snap features 156 of the main body 142 may be of the key-type or slot-type.

In some embodiments, different engagement features may be utilized. For example, the housing 139 includes a pair (i.e., two) of oppositely disposed slot and key features. As shown best in FIG. 5, the main body 142 includes a pair of slots 157 that are shaped to receive respective keys of the cover 144. While the slots 157 are shown as being cylindrical in shape, other suitable shapes may be used.

The main body 142 also includes one or more main body plugs 160 that extend from the compartment 154 at the top side 155 of the main body 142, through the main body 142 to a bottom side 162 (best shown in FIG. 6). Although illustrated with separate openings, it is contemplated that only a single main body plug 160 could be utilized. Other optional features of the main body 142 may include pin connectors, sleeve connectors, etc. for allowing transfer of power and/or data to and from the illumination device 135.

The main body 142 is configured to be mounted at a respective mounting section 133 of the liner 124 (FIG. 3), such as at an orifice of the liner 124. The lip 153 at the bottom side 162 includes an engagement surface 166 that has a major portion extending in a major plane 168 (FIG. 6) of the engagement surface 166. The engagement surface 166 is provided for mounting against the inner side 125 of the liner 124, with the portion of the main body 142 that defines the main body compartment 154 extending at least partially through a respective orifice of the liner 124 at the mounting section 133. In other embodiments, the main body 142 may have an engagement surface at the top side 155, such as also at the lip 153, for mounting to the outer side 126 of the liner 124. In such case, a majority of the main body 142 may be disposed external to the refrigerator compartment 114.

To provide efficient and uniform illumination of the refrigerator compartment 114, the main body 142 defines a curved reflecting portion 169 having a curved reflecting surface 170. This curved reflecting surface 170 extends between a front-located end 172 of the main body 142 to a rear-located end 174 of the main body 142. It will be appreciated that front and rear designations are indicated with respect to mounting of the main body 142 at the liner 124, with the term "front" designating in a direction towards the opening 127 of the refrigerator compartment 114, and the term "rear" designating in a direction towards a rear 128 (FIG. 3) of the refrigerator compartment 114. The curved reflecting surface 170 also extends along a majority of the main body longitudinal axis 152, such as having a constant curvature along this axis 152.

Shown best at FIG. 7, but also still referring to FIGS. 5 and 6, the curved reflecting surface 170 is disposed adjacent a location of arrangement of the LED lighting modules 140. The surface 170 curves from a bottom-located portion 176 to a top-located portion 178 in a direction from the front-located end 172 to the rear-located end 174. The depicted bottom-located portion 176 is disposed nearer the front-located end 172 than the rear-located end 174, and has a generally flat portion that extends in a direction generally orthogonal to a major front face 177 (FIG. 4) of the LED lighting modules 140, when installed. The surface 70 then curves in a direction toward the lip 153 along a lateral width 300 (FIG. 4) of the main body 142, towards the rear-located end 174. Alternatively-shaped curves may be provided in other embodiments. In some embodiments, the surface 170 may not be constant along the main body longitudinal axis 152.

The LED lighting modules 140 are arranged at a frontward section 182 of the main body compartment 154. The curved reflecting surface 170 extends outwardly from the frontward section 182 and from the LED lighting modules 140 to allow for light emitted from the LED lighting modules 140 to be incident on and reflected off of the curved reflecting surface 170, which is a concave surface with respect to the LED light sources, and into the refrigerator compartment 114. For example, in view of an arrangement of the LED lighting modules 140 relative to the housing 139, and to an arrangement of LED light sources to other aspects of the modules 140, the LED illumination devices 134 (including the illumination device 135) are configured such that a majority of light emitted from respective LED light sources is incident on the curved reflecting surface 170. Additionally, a majority of light emitted from the respective LED light sources is reflected off of the curved surface 170 prior to being incident on an inner surface of the cover 144.

Figure 8:
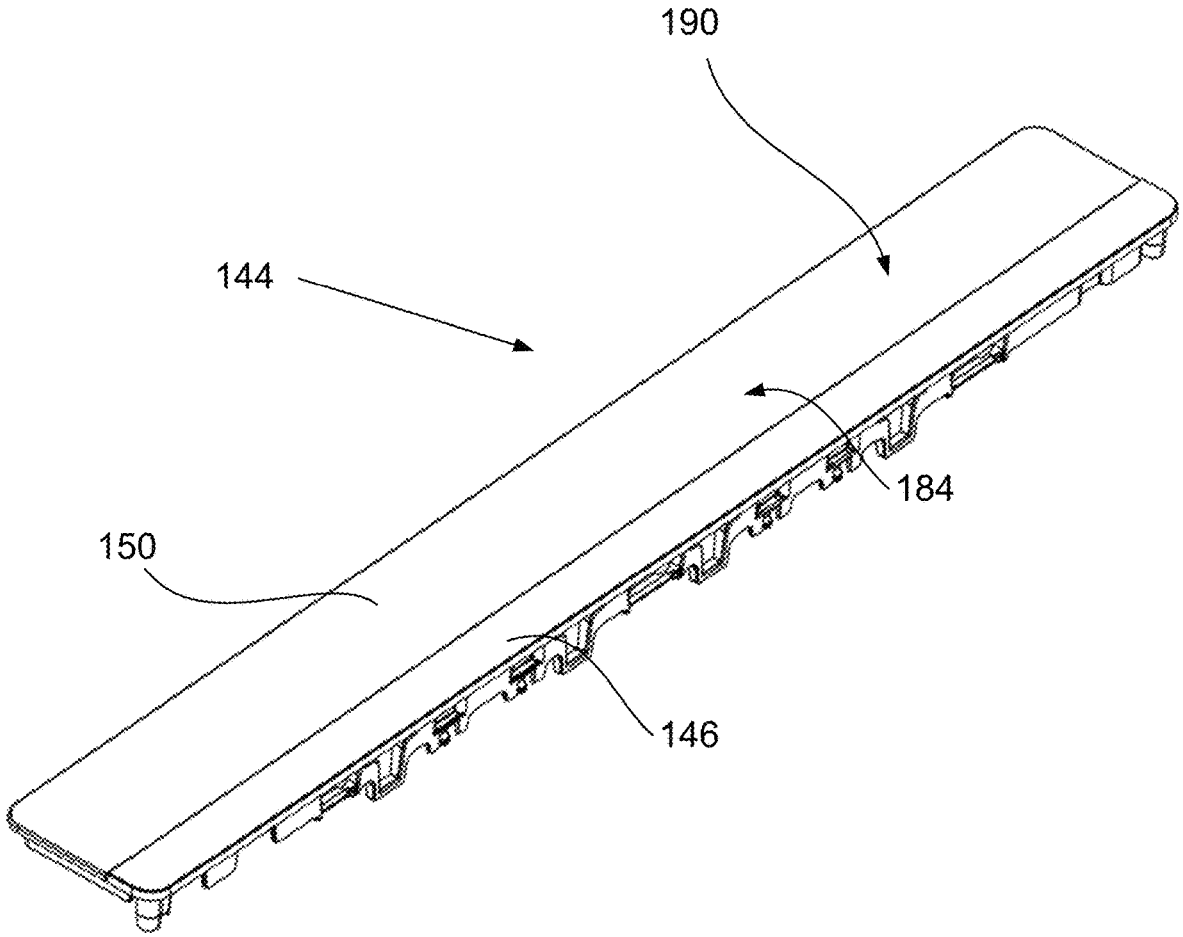
FIG. 8 a perspective view of the outer side of the cover of the illumination device of FIG. 4.
Figure 9:
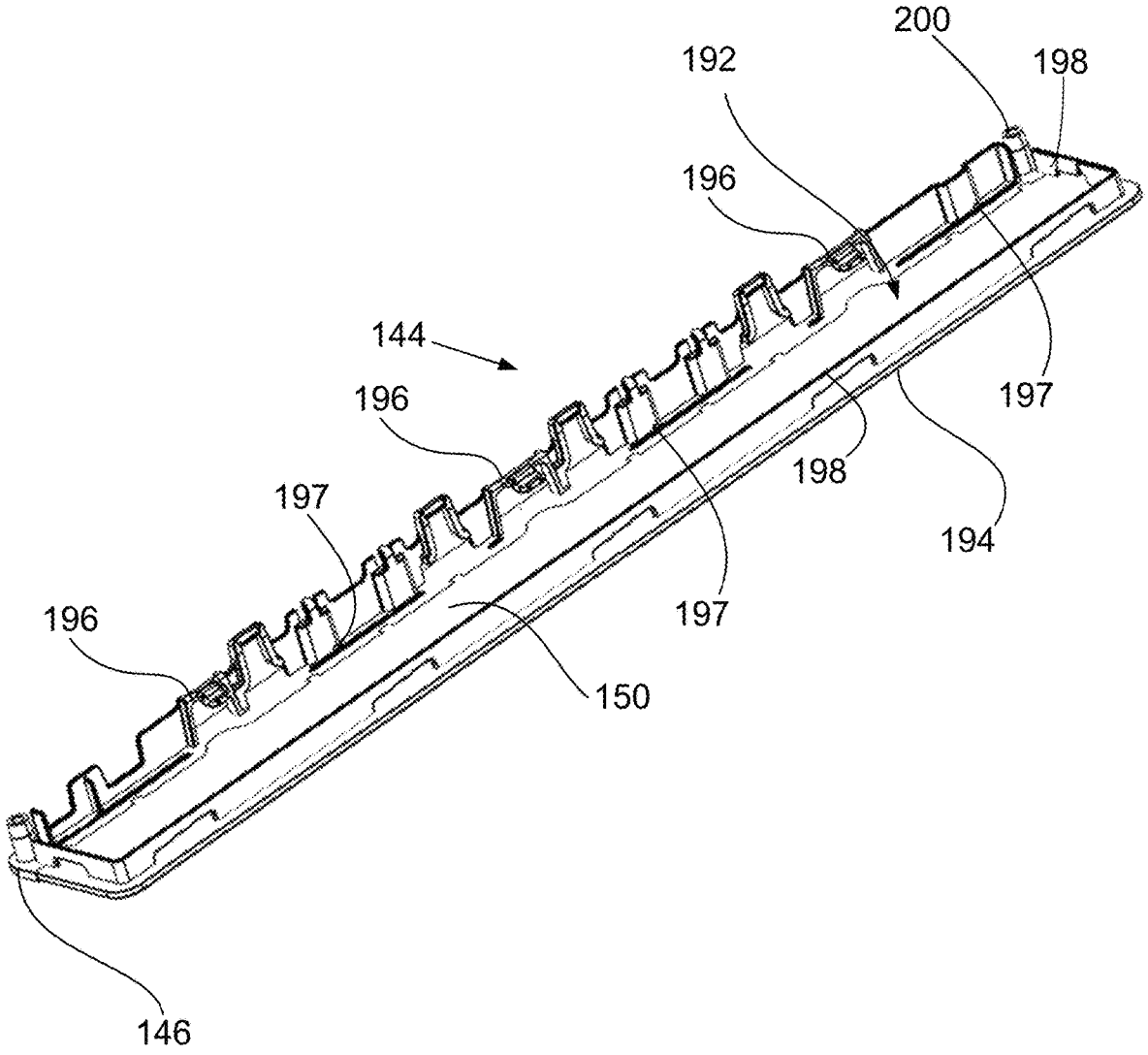
FIG. 9 is a perspective view of the inner side of a cover of the illumination device of FIG. 4.

The cover 144, also referred to as a cover member, is illustrated next at FIGS. 8 and 9. The cover 144 has a top side 190 disposed opposite a bottom side 192, the top side 190 including the outward area 146 and the lens area 150. The outward area 146 is disposed at a forward side (disposed closer to the opening 127) of the illumination device 135 when mounted at the liner 124, with the lens area 150 being disposed at the rear side of the illumination device 135 (disposed closer to the rear 128).

The bottom side 192 of the cover 144 includes aspects that allow for retaining the LED lighting modules 140, and thus allowing for the LED lighting modules 140 and the cover 144 to be brought into engagement with one another and thereafter jointly coupled to the main body 142. It also is contemplated that in other embodiments, the main body 142 instead or additionally may include aspects for retaining the LED lighting modules 140, such that the cover 144 instead may be brought into engagement with and coupled to a subassembly of the LED lighting modules 140 and the main body 142.

The cover 144 has a major outer surface 184 at the lens area 150 of the top side 190 that, when attached to the main body 142, is disposed generally parallel to an interior face of the respective mounting section 133 (at the interior surface 125 of the liner 124). An outer periphery 194 of the top area 190 may be tapered radially outwardly. In such case, the major outer surface 184 is generally flush, or disposed minimally outwardly from the liner 124 (outward into the refrigerator compartment 114) from the mounting section 133, with the tapering of the outer periphery providing for use of the illumination device 135 with liners 124 of varying thicknesses. This arrangement provides for minimal intrusion into usable space of the refrigerator compartment 114 and generally reduces, or altogether prevents, the user or items from being caught on an aspect of the illumination device 135 during use of the refrigerator 100.

When engaged with the main body 142, the lens area 150 is disposed over a majority of the curved reflecting surface 170. The lens area 150 is generally at least partially transparent to allow for dispersion of light emission from the LED light sources into the refrigerator compartment 114. In one embodiment, the lens area 150 is configured, such as via its surface disposition, to allow transmittance of light through the lens area 150 at all angles. In such embodiment, the lens area 150 is not configured to provide passive direction of light incident on an underside of the lens area 150 and originating from the respective LED light sources of the respective LED lighting modules 140. In another embodiment, at least a part of the lens area 150 is configured, such as via a surface disposition or surface treatment, to provide particular angular diffusion of light rays dispersing therethrough.

When engaged with the main body 142, the outward area 146 is disposed generally over the LED lighting modules 140 and their respective LED light sources. The general opacity of the material of the outward area 146 reduces, or altogether prevents, light emission through the outward area 146, thus more effectively allowing for direction of light into the refrigerator compartment 114 rather than at the opening 127 (FIG. 3) or at a user disposed generally at the opening 127.

At the bottom side 192 of the outward area 146, the cover 144 includes module retaining members 196 that are positioned to retain the LED lighting modules 140 between the retaining members 196 and the underside of the outward area 146/lens area 150 of the cover 144. The retaining members 196 may be shaped to provide some biasing of the LED lighting modules 140 towards the underside of the outward area 146/lens area 150. As illustrated, three retaining members 196 are provided, with one retaining member 196 being provided to engage one a trio of LED lighting modules—thus making the illumination device 135 a 3-by device. The retaining member 196 may be at least slightly biasable to enable easy insertion and removal of the modules 140.

The bottom side 192 also includes raised tabs 197 that are configured, such as being shaped, to mate with corresponding notches 199 (FIG. 10) at respective edges 220 (FIG. 19) of the LED lighting modules 140. The raised tabs 197 and notches 199 jointly provide for proper alignment of the LED lighting modules 140 with the cover 144, and thus serve as poke-yoke features.

In addition to the retaining members 196 and raised tabs 197, the cover 144 defines a plurality of snap features 198 disposed at each of the areas 146 and 150. The snap features 198, such as key-type or slot-type, are provided for mating with the corresponding snap features 156 of the main body 142. In the depicted embodiment, each of the main body and the cover 144 include a mix of slot-type and key-type snap features, with some of the key-type snap features 156, 198 being slightly biasable to enable retention with the slot-type snap features 156, 198.

As indicated above, the housing 139 also includes a pair (i.e., two) of oppositely disposed slot and key features. As illustrated at FIG. 9, the cover 144 includes a pair of keys 200 for being received by the slot-type snap features 156 of the main body 142. The keys 200 are shown as being cylindrical in shape, although other suitable shapes may be used.

Additionally or alternatively, while three LED modules 140 are depicted, more or fewer modules 140 may be included where suitable, for example forming a 1-by, 2-by, or 4+-by.

Figure 10:
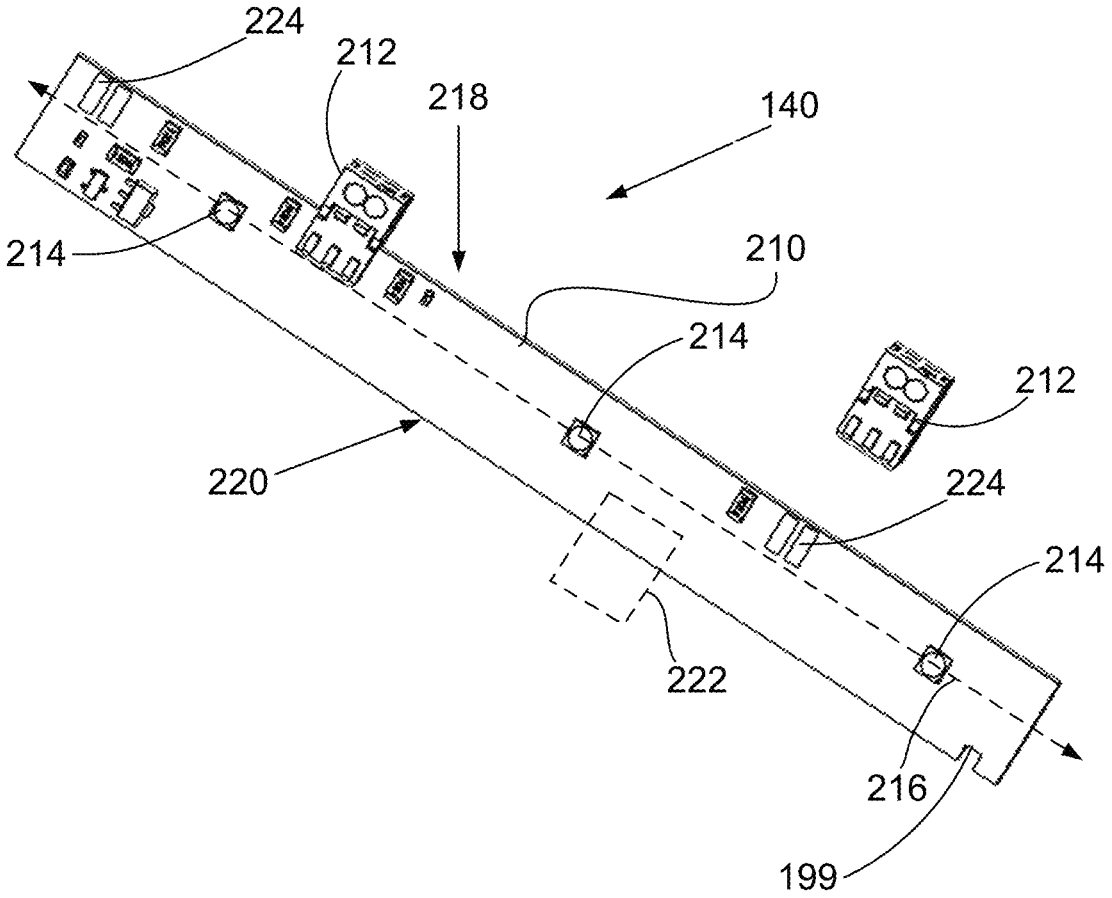
FIG. 10 is a front perspective view of an LED lighting module of the illumination device of FIG. 4.

Referring now to FIG. 10, one LED lighting module 140 is illustrated separate from the cover 144 and the main body 142. Generally, the module 140 is sized to be used with a variety of differently sized housings, such that one LED lighting module 140 is interchangeable with another LED lighting module 140 for ease of manufacturing, maintenance and repair. The depicted lighting module includes a board member 210, one or more electrical edge connectors 212, and one or more LED light sources 214.

The board member 210 is illustrated as a printed circuit board (PCB), although other board types may be used. The board member 210 extends along a longitudinal board axis 216 and has a lower edge 218 and an upper edge 220 (disposed opposite the lower edge 218) that are each disposed generally parallel to the board axis 216. The designations "upper" and "lower" are made with respect to the top (upper) and bottom (lower) designations of the main body 142 and the cover 144. The electrical edge connectors 212 are disposed at the lower edge 218. When engaged with the cover 144, the upper edge 220 is disposed adjacent a planar portion of the underside of the outward area 146/lens area 150, while the lower edge 218 is engaged by a retaining member 196.

A plurality of LED light sources 214 are provided, coupled to the board member 210 and disposed at positions longitudinally spaced apart, such as equally spaced apart, from one another along the board axis 216. The LED light sources 214 are electrically connected to one another and to the board member 210, such as via the coupling to the board member 210. In other embodiments, separate connection may be made. Preferably, the LED light sources 214 are electrically connected to one another in parallel. The depicted LED light sources 214 are surface-mount diode (SMD) LEDs having generally planar emission surfaces that are arranged generally parallel to a plane 222 of the board member 210.

The LED light sources 214 are generally arranged within the housing 139 to emit light in a direction parallel to the major outer surface 184 of the cover 144, as shown in FIG. 4. For example, when engaged with the cover 144, the LED lighting modules 140 are disposed such that the board members 210 extend generally orthogonal to the major outer surface 184, although alternative alignment may be suitable. The LED light sources 214 are aimed such that a majority of light emitted from the LED light sources is incident on the concave reflecting surface 170.

In other embodiments, LED light sources 214 and/or the respective board members 210 may be otherwise arranged; any suitable number of LED light sources may be included; spacing between the LED light sources may not be equal; one or more LED light sources may be of an alternative type, such as chip-on-board (COB) LEDs or direct-in-line package (DIP) LEDs; and/or the LED light sources may not have generally planar emission surfaces.

The LED light sources 214 are powered via electrical connection between electrical edge connections 224 of the board member 210, facilitated via associated wiring and the electrical edge connectors 212. The board member 210 includes a plurality of, and as depicted, three, electrical edge connections 224 commonly disposed at the lower edge 218. Preferably, the electrical edge connections 224 are each electrically connected in parallel to one another, to allow for an electrically parallel connection of two or more LED lighting modules 140 to one another, such as where the LED lighting modules 140 are disposed within a single housing 139 or where the modules 140 are disposed in different housings 139/different illumination devices 134. Optionally, one or more discrete, non-parallel connections could be used.

The edge connections 224 of the board member 210 allow for electrically parallel connection, e.g., daisy chaining, of the main bodies 142 of a plurality of illumination devices 134 prior to a foaming operation being performed on the respective refrigerator 100. For example, at such point in the manufacturing process, the respective covers 144 and the respective LED lighting modules 140 may not be attached to the main bodies 142.

Any of the electrical edge connections 224 may be a power input or a power output. Three electrical edge connections 224 are provided so that one connection 224 may be used as a power input, a second connection 224 may be used as a power output, and a third connection 224 may be further power output or an auxiliary in case of failure of one of the other connections 224.

Figure 13:
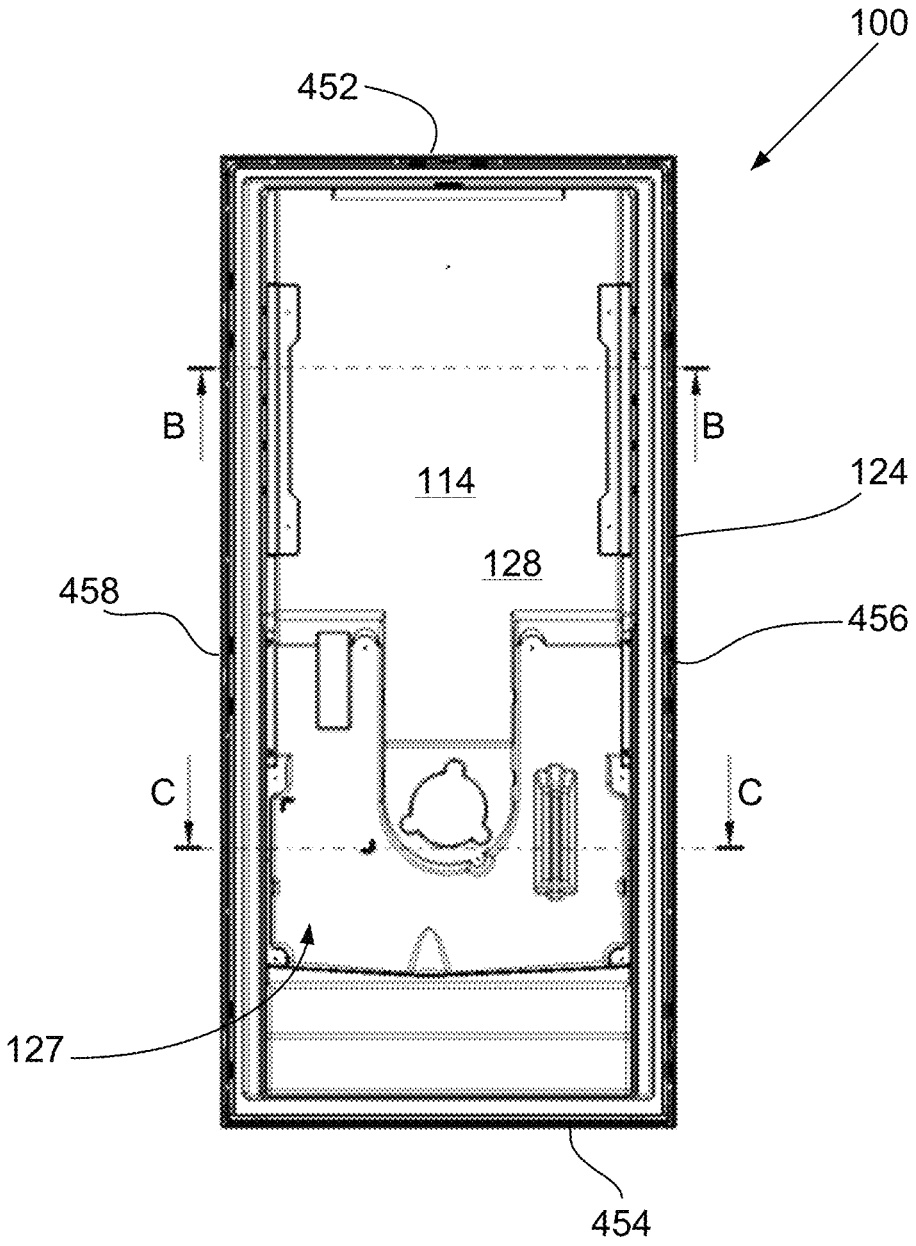
FIG. 13 is a front view of the refrigerator of FIG. 3.

Three of the interchangeable LED lighting modules 140 are included in the 3-by LED illumination device depicted in FIG. 4, such as being disposed generally in line with one another. In particular, the three LED lighting modules 140 are disposed adjacent one another, are electrically connected in parallel, and have respective board axes 216 (FIG. 13) disposed parallel to one another, and even more particularly disposed collinear with one another. In this way, the modules 140 are arranged to provide minimal interference to LED light sours 214 of one another. In other embodiments, the modules 140 may be otherwise suitably arranged, such as being connected non-parallelly.

At least one electrical edge connection 224 of one of the three LED lighting modules 140 is connected to at least one electrical edge connection 224 of another one of the three LED lighting modules 140 to facilitate internal daisy-chaining or electrically parallel connection of the two respective LED lighting modules 140 to one another. The illustrated connection is made via connection wiring 226.

The electrical edge connectors 212, connected via the wiring 226, allow for this electrically parallel connection. In an exemplary use, each of the three LED lighting modules 140 contained in the illustrated LED illumination device 135 includes two electrical edge connectors 212. For example, a first module 140 (leftmost in FIG. 4) includes one edge connector 212 coupled to one of the edge connections 224 and the other edge connector (not shown) will be coupled to a plug 160 of the main body 142 that serves as a power input connection. A second module 140 (middle in FIG. 4) includes two edge connectors 212 coupled to two of the edge connections 224. A third module 140 (rightmost in FIG. 4) includes one edge connector 212 coupled to one of the edge connections 224 and the other edge connector (not shown) will be coupled to a plug 160 of the main body 142 that serves as a power output connection (again, see, e.g., FIG. 5). The output can drive other lighting modules remotely, located in the refrigerator, such as other side-located modules, or top-, bottom- or rear-located modules.

The plugs 160 of the main body 142 are shaped and constructed such that the same electrical connectors 212 may be used to connect both to the main body plugs 160 and to the board member electrical connections 224. This arrangement provides for interchangeability of use of the electrical edge connectors 212, further providing for ease of manufacturing, maintenance and repair of the LED illumination devices 134. In other embodiments, different electrical connectors may be used to connect to the plugs 160, where the plugs 160 are differently constructed.

As touched on above, the inclusion of a plurality of LED lighting modules 140 allows for the illumination devices 134 of the present disclosure to have modular construction. Via the interchangeability of the modules 140 and via construction of the housing 139 to allow for the interchangeability, the same module 140 (or modules) may be used in similarly constructed but differently sized housings for providing different quantities or patterns of illumination. Such differently sized housings of differently sized illumination devices may be used in a single refrigeration appliance. For example, with brief reference again to FIG. 3, each of the illumination devices 135 and 136 use the same interchangeable LED lighting modules 140. However, the device 136 is a wider 2-by device as compared to the more narrow 3-by device 135.

Figure 11:
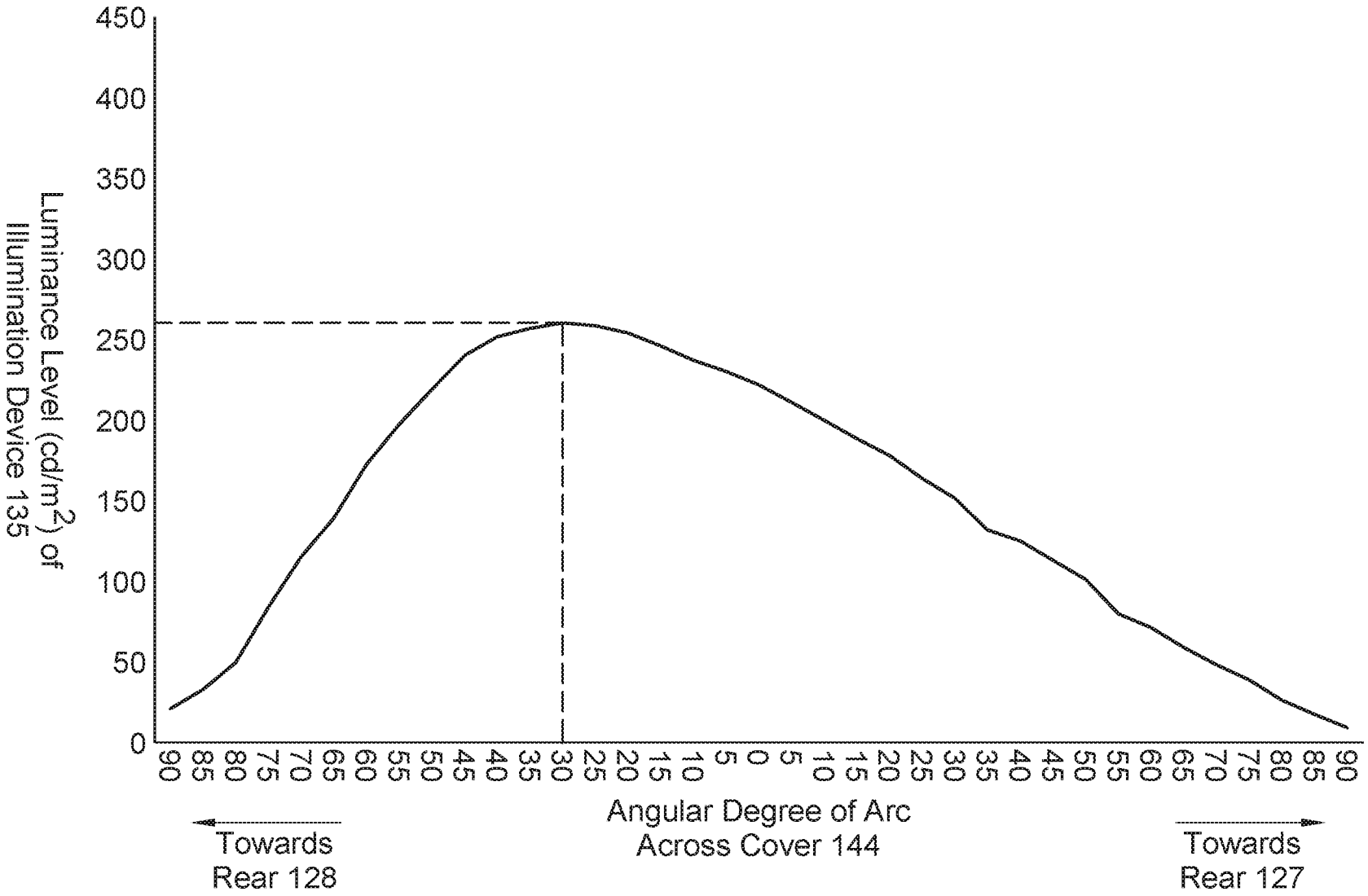
FIG. 11 is a graph plotting the level of luminance (X-axis) at each angular degree of a 180 degree arc extending from the illumination device of FIG. 4 as mounted in the refrigerator of FIG. 3.

Referring again to the illumination device 135, a graph is illustrated at FIG. 11 that demonstrates the illumination range of the modular LED illumination device 135. The graph of FIG. 11 plots level of luminance (X-axis) at each angular degree (Y-axis) of a 180 degree arc extending from the major outer surface 184 (FIG. 4) of the cover 144 of the illumination device 135 and arcing across the lateral width 300 (FIG. 4) of the cover 144. The Y-axis of the graph defines 0 degrees as extending outwardly from the cover 144 and being normal to (orthogonal to) one or more of the major outer surface 184, the major plane 168 (FIG. 6) of the engagement surface 166 of the main body 142 (FIG. 6), or a plane of the mounting section 133 of the liner 124 (FIG. 3), which three aspects generally are disposed parallel to one another in a preferred embodiment, as depicted in FIG. 3. The positive designation is directed rearward towards the rear 128 (FIG. 3) of the refrigerator compartment 114, and the negative designation is directed frontward towards the opening 127 of the refrigerator compartment 114.

As depicted in FIG. 11, the LED illumination device 135 is configured such that light is directed both in a direction toward the opening 127 of the refrigerator compartment 114 and towards the rear 128, disposed opposite the opening 127. A direction of light emitted having a peak brightness is disposed at an acute angle relative to the major plane 168 (FIG. 6) of the engagement surface 166 of the main body 142. The illumination device 135 may be configured to provide the peak brightness within different angular ranges, such as via mounting/alignment of the modules 140 relative to the curved reflecting surface 170 (FIG. 7), and relative to the cover 144. For example, the illumination device 135 may be configured to provide the peak brightness within a range preferably between and inclusive of about 15 degrees to about 65 degrees, more preferably between and inclusive of about 20 degrees to about 60 degrees, and even more preferably between and inclusive of about 25 degrees to about 35 degrees, such as at about 30 degrees from the normal axis. Put another way, the LED lighting module 140 and the housing 139 are mounted to one another and relative to the mounting section 133 to control the pattern of light distributed from the illumination device 135 such that the peak brightness extends between and inclusive of about 20 degrees and about 60 degrees with respect to the normal axis extending perpendicular to a surface of the mounting section 133 at which the illumination device 135 is mounted. The specific peak brightness illustrated at FIG. 11 is provided at about 30 degrees from the normal axis and has a luminance of about 260 cd/$m^2$.

As shown at FIG. 11, it will be appreciated that a minor portion of light having low luminance is directed towards the opening 127. Thus, a pattern of light is emitted by the illumination device 135 into the refrigerator compartment 114 that arcs between light directed rearward towards the rear 128 and light directed frontward towards the opening 127, disposed opposite the rear 128.

Figure 2:
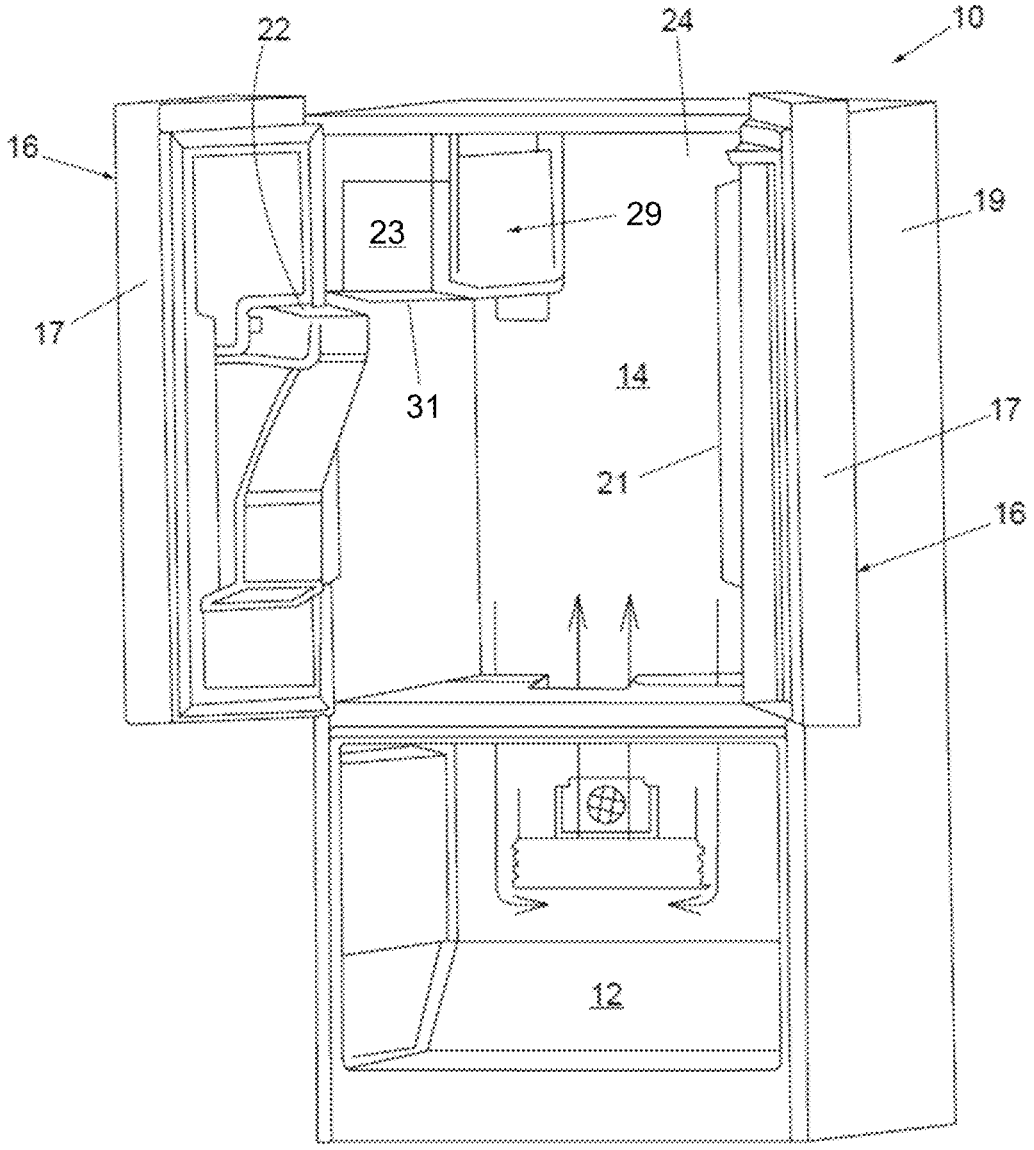
FIG. 2 is a front perspective view of the refrigerator of FIG. 1 showing the doors of the fresh food compartment and the drawer of the freezer compartment in an opened position.
Figure 12:
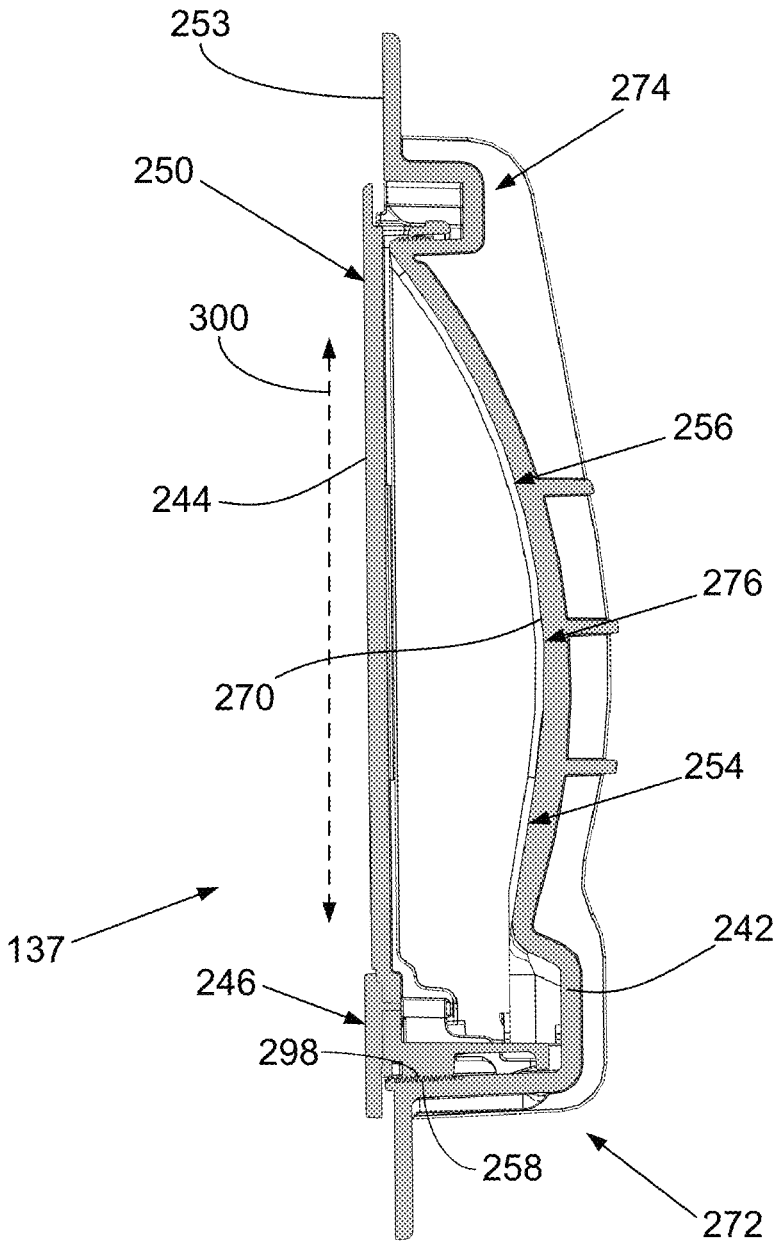
FIG. 12 is a cross-section view of an alternative illumination device embodiment.

Referring now to FIG. 12, an alternative main body embodiment is depicted at 242, coupled to a corresponding alternative cover embodiment 244, which elements are included in the ceiling illumination device 137 of FIG. 2. The main body 242 is substantially similar to the main body 142, except as described herein. Similar to the main body 142, the main body 242 defines a curved reflecting portion having a curved reflection surface 270. This curved reflecting surface 270 extends between a front-located end 272 of the main body 242 to a rear-located end 274 of the main body 242, and has a generally constant curvature along a longitudinal length of the main body 242.

Shown at FIG. 12, the surface 270 has a curve apex 276 disposed intermediately, such as generally centrally, between the front-located end 272 and the rear-located end 274. That is, between the ends 272 and 274, the curvature of the surface 270 along a lateral width 300 is generally set first is in a direction away from a lip 253, at the section 254, to the curve apex 276. The curvature then proceeds thereafter, at the section 256, oppositely toward the lip 253, towards the rear-located end 274. The illustrated apex 276 is nearer the front-located end 272 than the rear-located end 274. In some embodiments, the surface 270 may not be constant along the longitudinal length of the main body 242.

Similar to the main body 142, the curved reflecting surface 270 of the ceiling main body 242 extends outwardly from the front-located end 272 and from a location of the LED lighting modules 140 (not shown) to allow for light emitted from the LED lighting modules 140 to be incident on and reflected off of the curved reflecting surface 270, which is a concave surface with respect to the LED light sources, and into the refrigerator compartment 114 (FIG. 2). For example, in view of an arrangement of the LED lighting modules 140 relative to the housing 139, and to an arrangement of LED light sources to other aspects of the modules 140, the LED illumination device 137 is configured such that a majority of light emitted from respective LED light sources is incident on the curved reflecting surface 270. Additionally, a majority of light emitted from the respective LED light sources is reflected off of the curved surface 120 prior to being incident on an inner surface of the respective cover 244.

The cover 244 is substantially similar to the cover 144, except as described herein. The cover 244 is shown as including an outward area 246 provided at an element that is overlaid onto the lens area 250, such as being adhered or otherwise suitably coupled thereto. Further, each of the main body 242 and cover 244 include complementary snap features 258 and 298, respectively. These snap features 258, 298 are depicted as complementary ratchet-type features, although other feature types may be suitable.

Turning now to FIGS. 13 to 16, and also to FIG. 3, the liner 124 of the refrigerator 100 further will be described with respect to the effect of the liner 124 on direction of light into the refrigerator compartment 114. To further direct a greater portion of light towards the rear 128, while also reducing the chance of the user at the opening 127 perceiving a pinpoint light from illumination devices 134 positioned adjacent the opening 127, the liner 124 is uniquely constructed. The unique construction eliminates the need for a housing of an illumination device to extend angularly from the respective liner to better direct light toward the respective rear of a refrigerator compartment. To achieve one or more of these benefits, the liner 124 includes the mounting section 133, where the mounting section 133 is angled inwardly towards a wall of the refrigerator compartment 114 disposed opposite the wall including the mounting section 133.

Referring now in particular to aspect of the liner 124, included is a rear wall 450, a top wall 452, a bottom wall 454 disposed opposite the top wall 452, a left side wall 456, and a right side wall 458 disposed opposite the left side wall 456. The top, bottom, left side and right side walls 452, 454, 456 and 458 are with one another and extend outwardly from the rear wall 450 to respective end portions 460. These walls define the generally rectangular refrigerator compartment 114 which has an open side defining the opening 127.

The opening 127 extends along an opening plane 467. A bisecting plane 470 (FIG. 14) of the refrigerator compartment 114 is disposed orthogonal to the opening plane 467 and extends between the opening plane 467 and the rear wall 450. A respective end portion 460 of at least one of the top wall 452, the bottom wall 454, the left side wall 456, or the right side wall 458 has a mounting section 133 for having an illumination device 134 mounted thereto.

As depicted, each of the left side wall 456 and the right side wall 458 include a respective mounting section 133. The mounting sections 133 extend vertically along portions of the left and right side walls 456 and 458 adjacent the end portions 460. Generally, the mounting sections 133 have a constant depth along a direction normal to the vertical direction, and along a full vertical length of the respective mounting section 133.

Each of the mounting sections 133 extends along an inward draft direction 471 that is directed outwardly from the compartment 114 and toward the bisecting plane 470. Specifically, the inner surface 472 of each mounting section 133 extends along the inward draft direction 471. Comparatively, a typical outward draft direction, such as the outward draft direction 473 of major portions 474 of the left and right side walls 456, 458, is directed outwardly from the compartment 114 and also away from the bisecting plane 470. For example, looking specifically to FIGS. 14 and 15, the major portions 474 have outward draft angles 475 in a range preferably between and inclusive of about 1 degree to about 10 degrees, more preferably between and inclusive of about 2 degrees to about 9 degrees, and even more preferably between and inclusive of about 3 degrees to about 8 degrees, such as at about 7 degrees from a plane extending orthogonally outwardly from a vertically-extending major plane of the rear 128 of the respective refrigerator 100. See, e.g., the bisecting plane 470. These outward draft angles 475 are provided to allow for ease of removal of the respective liners from a mold, such as in the case of a vacuum form molded liner.

Figure 15:
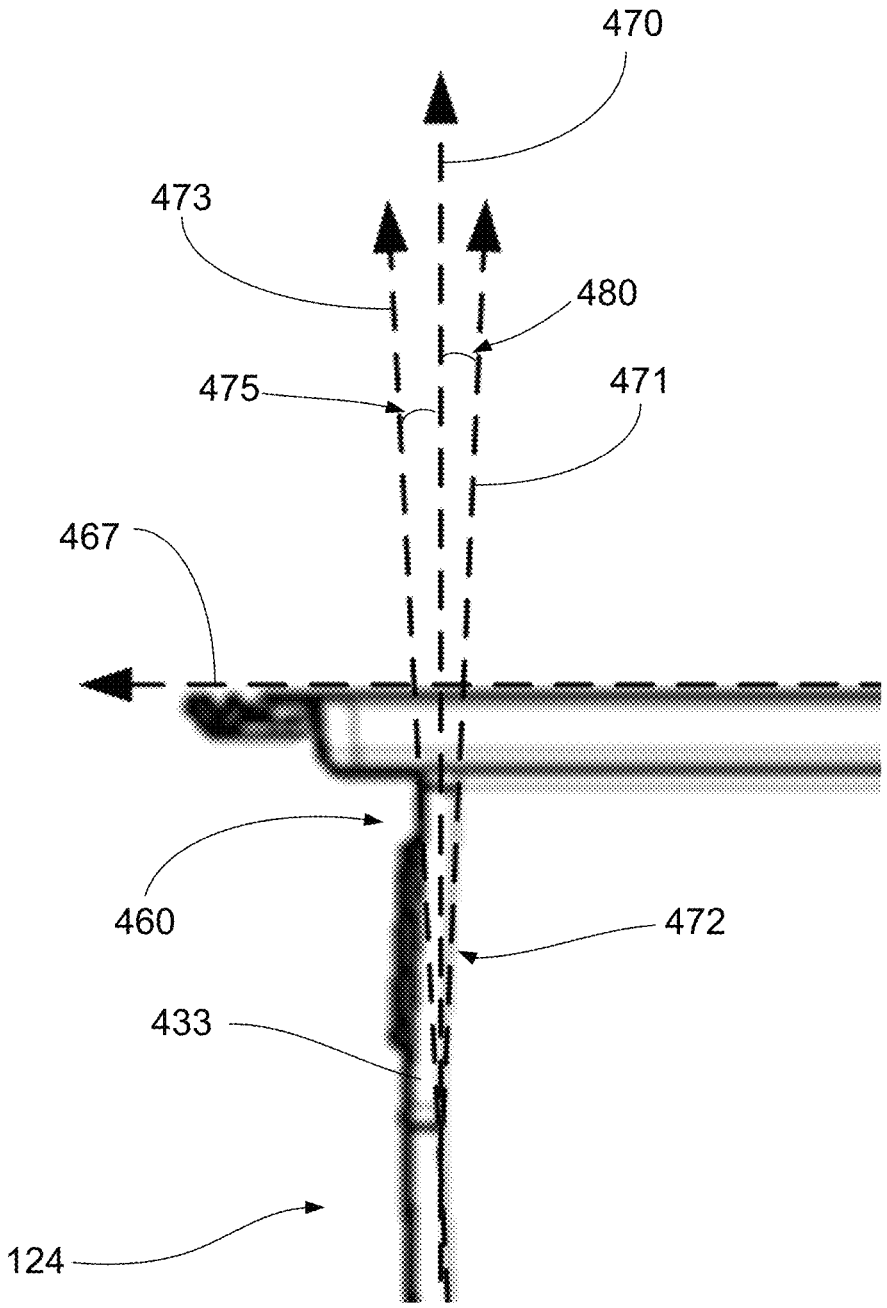
FIG. 15 is an enlarged view of section D-D of the view of FIG. 14.
Figure 16:
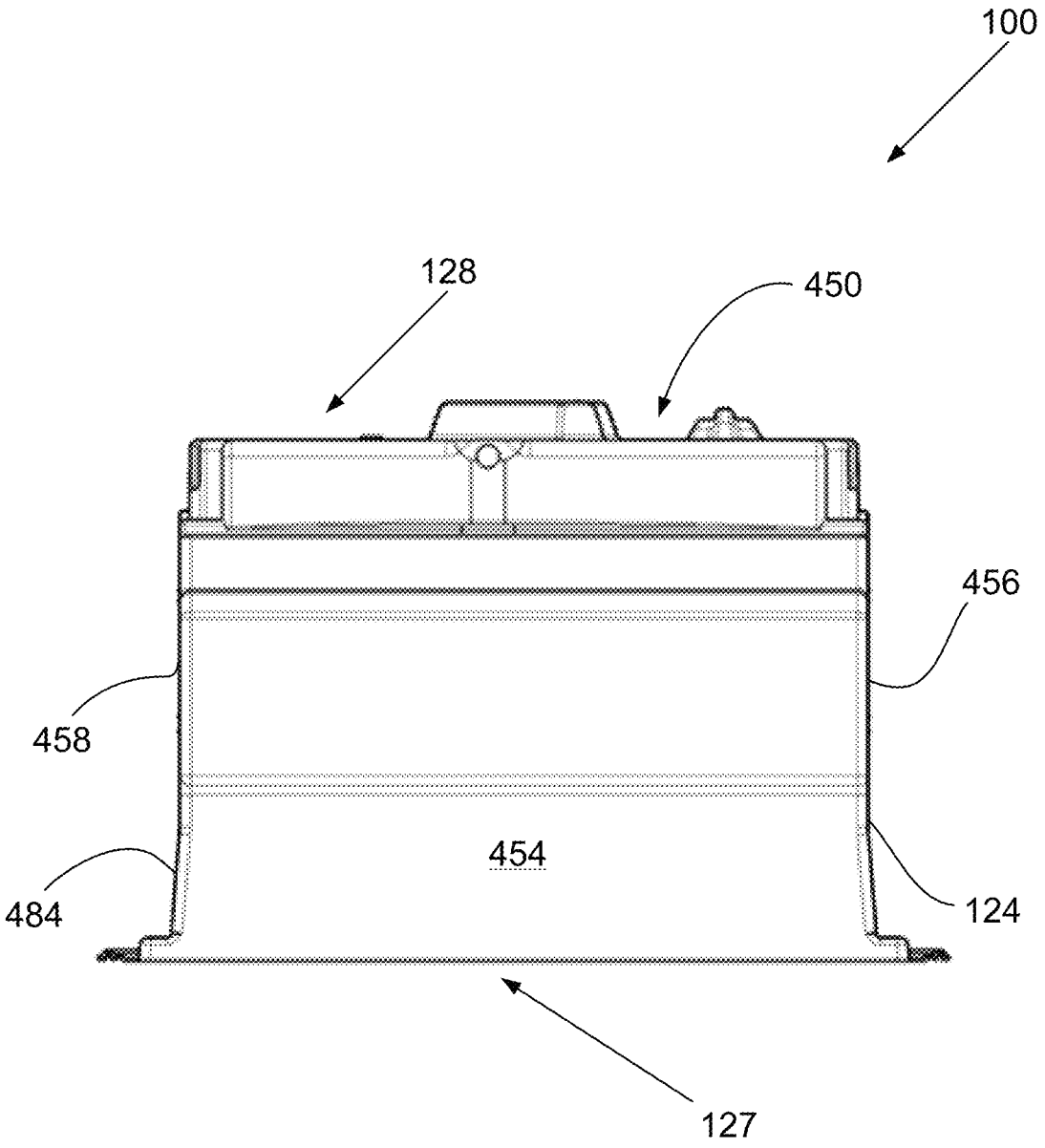
FIG. 16 is a view of the refrigerator taken along line C-C of FIG. 13.

It is noted that in the partial view of FIG. 15, the bisecting plane 470 is moved leftward on the page, towards the right side wall 458, to easier show an exemplary outward draft angle 475, and also an exemplary inward draft angle 480, without the need to extend each of the outward draft direction 473 and inward draft direction 471 until intersection with the true position of the bisecting plane 470.

With respect to the mounting sections 133, and shown best at FIGS. 14 and 15, at an intersection with the bisecting plane 470, the inward draft direction 471 forms the inward draft angle 480 disposed therebetween (between the bisecting plane 470 and the inward draft direction 471). The inward draft angle 480 is within a range disposed preferably between and inclusive of about 1 degree and about 20 degrees, more preferably between and inclusive of about 3 degrees and about 15 degrees, and even more preferably between and inclusive of about 5 degrees and about 10, such as about 7 degrees. Thus, the preferred outward draft angles 475 and inward draft angles 480 may be equal in absolute quantity, but opposite in direction.

To reduce the vertical extent of the mounting sections 133, in some cases providing an easier removal from a mold, such as from a mold, such as a vacuum form mold, a transition section 482 (FIG. 3) extends along each of the left and right side walls 456 and 456 between the opening 127 and the rear 128. The transition sections 482 allow for gradual change in a vertical direction from the inward draft angles 480 of the mounting sections 133 to a typical outward draft angle 475 of vertically extending sections 484 (FIGS. 3 and 14) disposed directly below the mounting sections 133.

Figure 17:
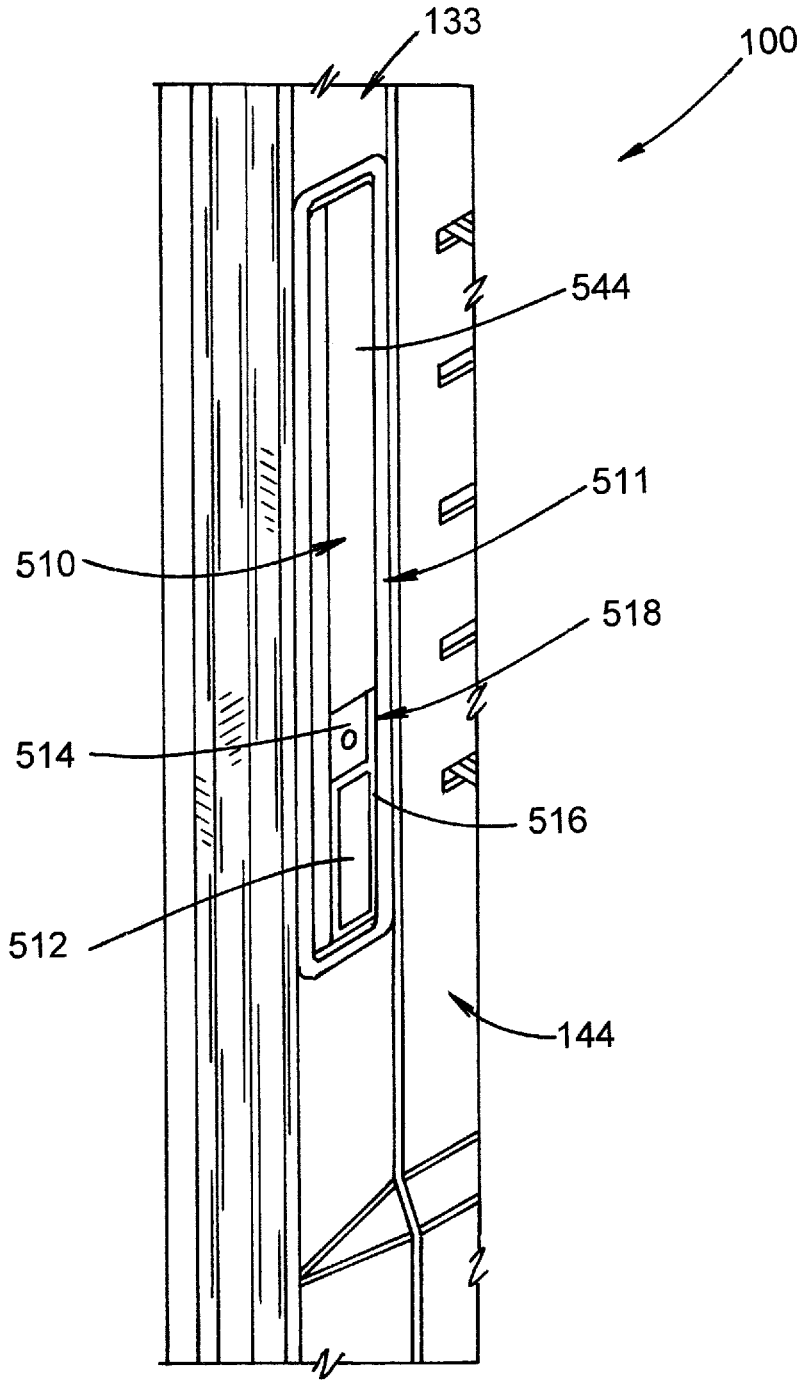
FIG. 17 is a partial view of the refrigerator of FIG. 3 including an alternative illumination device.
Figure 18:
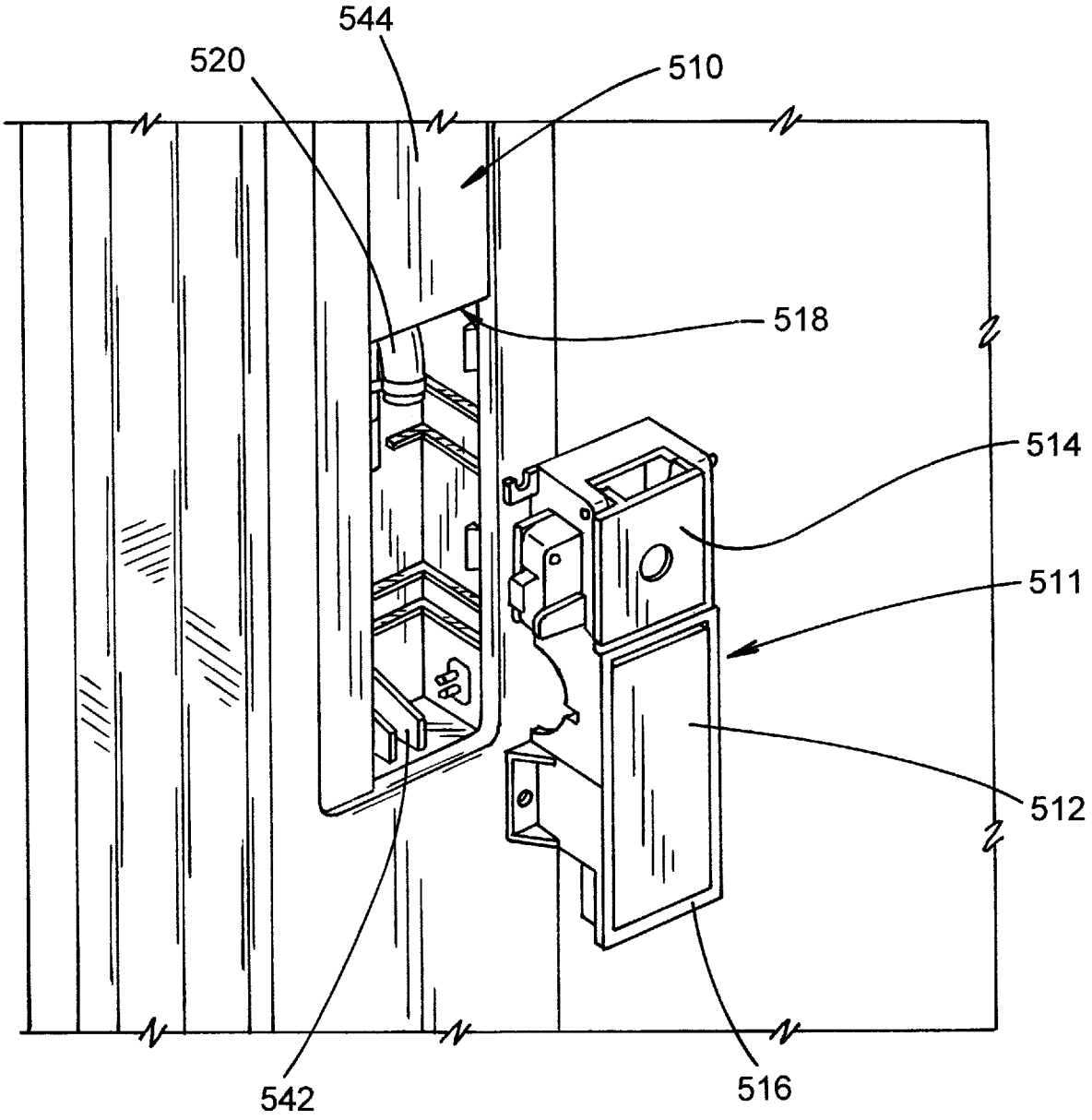
FIG. 18 is a partial exploded view of a portion of the partial view of FIG. 17, showing a dispensing mechanism removed from an illumination device.

Finally, referring again to FIG. 3, and also to FIGS. 17 and 18, an exemplary refrigerator, such as the refrigerator 100 can include an alternative modular LED illumination device 510, such as in the location of one of the depicted illumination devices 135 of FIG. 3. Shown best at FIG. 17, such alternative illumination device 510 can include a dispensing mechanism 511 having a water dispenser 512 and an activation switch 514 for causing water to dispense from the water dispenser 512. The water dispenser 512 can be a push-push mechanism being pushable to cause the dispenser 512 to at least partially pivot outwardly from the inner wall of the compartment 114. Upon pushing the activation switch 514, which may be a paddle switch, for example, water may be dispensed.

Each of the water dispenser 512 and the activation switch 514 can be mounted to a main body 516. The main body 516, as shown best in FIG. 18, can be mounted within the illumination device 510, such as within an opening 518 of the respective cover 544. That is, one or more respective lighting modules (not shown) may not extend a full length of a respective main body 542 of this respective illumination device 510, and instead may only be located at an upper section (or bottom section if flipped) of the device 510. One or both of the cover 544 and the main body 542 of the device 510 may include a wall portion (not shown), to separate the lighting modules from the dispensing mechanism 511. The particular main body 542 of the device 510 may have a tube end 520 received into or integral with the main body 542, for connecting to the water dispenser 512.

Via the device 510, both a light and a water dispensing mechanism 511 may easily be attached at various locations of liners of varying refrigerators. Additionally, due to the modularity of the devices 134, a respective cover and main body of any suitable size lighting device 134 may be configured to receive a dispensing mechanism 511, to allow for placement in varying refrigerator types and/or at varying locations within a respective compartment.

In summary, a refrigeration appliance 10, 100, 500 includes a compartment 14, 114 for storing food items in a refrigerated environment, the compartment 14, 114 being illuminated by at least one modular LED illumination device 134, 135, 136, 336, 510. The portion of the illumination device 134, 135, 136, 336, 510 disposed within the compartment 14, 114 is generally flush with a mounting section 133 and includes an LED lighting module 140 arranged in a housing 139. The module 140 has a board member 210, two or more LED light sources 214 electrically connected to one another and to the board member 210, and two or more electrical edge connections 212 for allowing electrically parallel connection between two or more modules 140 being interchangeable with one another. A concave reflecting surface 170 is positioned adjacent the module 140 with a majority of light emitted from the LED light sources 214 being incident thereon for reflection into the compartment 14, 114. A liner 24, 124 defining the compartment 14, 114 has the mounting section 133 to which the housing 139 is mounted, where the mounting section 133 has an inward draft angle 480.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims and their equivalents.

What is claimed is:

1. A refrigeration appliance comprising:

a liner for defining a compartment for storing food items in a refrigerated environment, the liner comprising:

a rear wall;

a top wall and a bottom wall disposed opposite one another and extending outwardly from the rear wall to respective end portions;

oppositely disposed left and right side walls extending outwardly from the rear wall to a respective end portion, the left and right side walls being connected to the top and bottom walls to define a generally rectangular compartment having an open side;

the open side defining an opening extending along an opening plane; and a vertically extending bisecting plane of the compartment disposed orthogonal to the opening plane and extending between the opening plane and the rear wall, wherein a respective end portion of at least one of the top wall, bottom wall, left side wall or right side wall has a mounting section for having an illumination device mounted thereto, the mounting section extending along an inward draft direction that is directed outwardly from the compartment and inwardly toward the bisecting plane; and the illumination device including:

a housing mounted at the mounting section, an LED lighting module arranged in the housing, the module having a board member and two or more LED light sources electrically connected to one another and to the board member, and a concave reflecting surface positioned adjacent the module to reflect light incident on the concave reflecting surface into the compartment, the LED light sources being aimed such that a majority of light emitted from the LED light sources is incident on the concave reflecting surface, wherein the LED lighting module includes two or more electrical edge connections electrically connected in parallel to allow for an electrically parallel connection of two or more LED lighting modules to one another.

2. The refrigeration appliance of claim 1, wherein the illumination device includes two or more LED lighting modules arranged in the housing and connected to one another via electrically parallel connection between at least one electrical edge connection of one of the two or more LED lighting modules to at least one electrical edge connection of another one of the two or more LED lighting modules.

3. The refrigeration appliance of claim 2, wherein at least two of the two or more LED lighting modules are interchangeable with one another.

4. The refrigeration appliance of claim 2, wherein the LED lighting module includes an electrical edge connector coupled to a respective board member at the position of at least one of the one or more electrical edge connections, the edge connector having a wire attached thereto for connecting to another electrical edge connector not coupled to the respective board member.

5. The refrigeration appliance of claim 1, wherein the illumination device is configured to emit a pattern of light into the compartment, the pattern arcing between light directed rearward towards a rear of the compartment opposite the opening and light directed frontward towards the opening.

6. The refrigeration appliance of claim 5, wherein a majority of light emitted from the illumination device is directed rearward.

7. The refrigeration appliance of claim 1, wherein the illumination device has a direction of light emitted having a peak brightness, which direction defines a peak brightness direction disposed at an acute angle relative to a major plane of the engagement surface.

8. The refrigeration appliance of claim 1, wherein the housing includes a cover having a major outer surface, wherein the major outer surface is disposed generally parallel to an interior face of the mounting section, and wherein the cover is configured to allow transmittance of light through the cover at all angles.

9. The refrigeration appliance of claim 1, wherein the housing includes a main body coupled to the liner and a cover couplable to the main body, wherein the lighting module is retained at an underside of the cover, and wherein the cover and lighting module are jointly receivable at and couplable to the main body.

10. The refrigeration appliance of claim 1, wherein the illumination device is a first illumination device, and the refrigeration appliance further including a second illumination device having at least one lighting module retained therein, wherein the at least one lighting module of the second illumination device is interchangeable with the lighting module of the first illumination device.

11. An illumination device for being mounted at a wall of a liner of a refrigeration appliance, the liner comprising:

a rear wall;

a top wall and a bottom wall disposed opposite one another and extending outwardly from the rear wall to respective end portions;

oppositely disposed left and right side walls extending outwardly from the rear wall to a respective end portion, the left and right side walls being connected to the top and bottom walls to define a generally rectangular compartment having an open side;

the open side defining an opening extending along an opening plane; and a vertically extending bisecting plane of the compartment disposed orthogonal to the opening plane and extending between the opening plane and the rear wall, wherein a respective end portion of at least one of the top wall, bottom wall, left side wall or right side wall has a mounting section for having the illumination device mounted thereto, the mounting section extending along an inward draft direction that is directed outwardly from the compartment and inwardly toward the bisecting plane, the illumination device comprising:

a housing having an engagement surface mountable at the mounting section of the wall of the liner, the housing having a curved surface, and the housing including a main body and a cover removably couplable to the main body; and a pair of LED lighting modules retained by the cover and having a board member and two or more electrical edge connections electrically connected in parallel to allow for electrically parallel connection of the LED lighting modules to one another, wherein the LED lighting modules each further include two or more LED light sources electrically connected to one another and to the board member, and wherein a majority of light emitted from the two or more LED light sources is reflected off of the curved surface prior to being incident on an inner surface of the cover, and wherein the lighting modules are interchangeable in their respective positions retained by the cover.

12. The illumination device of claim 11, wherein the curved surface extends outwardly from the LED lighting modules and is positioned such that a majority of light emitted from the LED light sources is incident on the curved surface.

13. The illumination device of claim 11, wherein the illumination device has a direction of light emitted having a peak brightness, which direction defines a peak brightness direction disposed at an acute angle relative to a major plane of the engagement surface.

14. The illumination device of claim 11, wherein the board member of each LED lighting module is a printed circuit board on which the LED light sources are mounted and on which the edge connections are disposed.

15. The illumination device of claim 11, wherein the LED lighting modules each include three edge connections electrically connected in parallel and aligned along a common edge of the LED lighting module.

16. A liner for defining a compartment of a refrigeration appliance, the liner comprising:

a rear wall;

a top wall and a bottom wall disposed opposite one another and extending outwardly from the rear wall to respective end portions;

oppositely disposed left and right side walls extending outwardly from the rear wall to a respective end portion, the left and right side walls being connected to the top and bottom walls to define a generally rectangular compartment having an open side;

the open side defining an opening extending along an opening plane; and a vertically extending bisecting plane of the compartment disposed orthogonal to the opening plane and extending between the opening plane and the rear wall, wherein a respective end portion of at least one of the top wall, bottom wall, left side wall or right side wall has a mounting section for having an illumination device mounted thereto, the mounting section extending along an inward draft direction that is directed outwardly from the compartment and inwardly toward the bisecting plane.

17. The liner of claim 16, wherein at an intersection with the bisecting plane, the inward draft direction forms an inward draft angle disposed therebetween and opening outward from the compartment in a range disposed between and inclusive of about 1 degree and about 20 degrees.

18. The liner of claim 16, wherein each of the left and right side walls has a mounting section.

19. The liner of claim 16, wherein an outer portion of the mounting section is angled inwardly towards an opposite wall of the compartment to thereby direct light emitted at any angle from a cover of the illumination device inwardly towards the compartment and towards the bisecting plane rather than laterally outward away from the bisecting plane.

* * * * *